US009022546B1

(12) United States Patent
Breton et al.

(10) Patent No.: US 9,022,546 B1
(45) Date of Patent: May 5, 2015

(54) METHOD OF JETTING INK

(71) Applicant: Xerox Corporation, Norwalk, CT (US)

(72) Inventors: Marcel Philippe Breton, Mississauga (CA); Jennifer L. Belelie, Oakville (CA); Adela Goredema, Mississauga (CA); Paul F. Smith, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/089,479

(22) Filed: Nov. 25, 2013

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
CPC .... B41J 11/0015; B41J 2/0057; B41J 11/002; C09D 11/02; C09D 11/34
USPC ..... 347/20, 88, 95, 99, 100, 102, 103; 106/31.13, 31.27, 31.58, 31.6
See application file for complete search history.

(56) References Cited

U.S. PATENT DOCUMENTS

| | | | |
|---|---|---|---|
| 5,145,518 | A | 9/1992 | Winnik et al. |
| 5,146,087 | A | 9/1992 | VanDusen |
| 5,202,265 | A | 4/1993 | LaMora |
| 5,208,630 | A | 5/1993 | Goodbrand et al. |
| 5,225,900 | A | 7/1993 | Wright |
| 5,231,135 | A | 7/1993 | Machell et al. |
| 5,256,193 | A | 10/1993 | Winnik et al. |
| 5,271,764 | A | 12/1993 | Winnik et al. |
| 5,275,647 | A | 1/1994 | Winnik |
| 5,286,286 | A | 2/1994 | Winnick et al. |
| 5,301,044 | A | 4/1994 | Wright |
| 5,378,574 | A | 1/1995 | Winnik et al. |
| 5,385,803 | A | 1/1995 | Duff et al. |
| 5,539,038 | A | 7/1996 | Katsen et al. |
| 5,543,177 | A | 8/1996 | Morrison et al. |
| 5,554,480 | A | 9/1996 | Patel et al. |
| 5,593,807 | A | 1/1997 | Sacripante et al. |
| 5,621,022 | A | 4/1997 | Jaeger et al. |
| 5,945,245 | A | 8/1999 | Mychajlowskij et al. |
| 6,156,858 | A | 12/2000 | Keoshkerian et al. |
| 6,221,137 | B1 | 4/2001 | King et al. |
| 7,172,276 | B2 | 2/2007 | Breton et al. |
| 7,202,883 | B2 | 4/2007 | Breton et al. |
| 7,767,011 | B2 | 8/2010 | Bedford et al. |
| 8,142,557 | B2 | 3/2012 | Belelie et al. |

(Continued)

OTHER PUBLICATIONS

Eliyahu et al., "Inkjet Ink Containing Polystyrene-Co-Butyl Acrylate Latex Suitable for Indirect Printing Method", U.S. Appl. No. 14/067,469, filed Oct. 30, 2013, 23 Pages.

(Continued)

*Primary Examiner* — An Do
(74) *Attorney, Agent, or Firm* — MH2 Technology Law Group LLP

(57) ABSTRACT

An indirect printing process for printing a gel ink. The process comprises providing a gel ink composition in an inkjet printing apparatus. Droplets of gel ink are ejected in an imagewise pattern onto an intermediate transfer member wherein each ink droplet forms a substantially circular image on the transfer member. The ink droplets are gelled and dried or solidified to form a substantially dry ink pattern on the intermediate transfer member. The substantially dry ink pattern is transferred from the intermediate transfer member to a final substrate.

18 Claims, 4 Drawing Sheets

(56) References Cited

U.S. PATENT DOCUMENTS 8,268,399 B2 * 9/2012 Gervasi et al. ..... 427/277
8,350,879 B2 1/2013 Larson et al.

OTHER PUBLICATIONS

"Dimer Acids," Kirk-Othmer Encyclopedia of Chemical Technology, vol. 8, 4th Ed. (1992), pp. 223-237.

Jikei et al. "Synthesis and Properties of Hyperbranched Aromatic Polyamide Copolymers from AB and AB2 Monomers by Direct Polycondensation", Macromolecules 2000, 33, pp. 6228-6234 (2000).

Eliyahu et al., "Inkjet Ink for Indirect Printing Applications", U.S. Appl. No. 14/066,716, filed Oct. 30, 2013, 37 Pages.

* cited by examiner

METHOD OF JETTING INK

DETAILED DESCRIPTION

1. Field of the Disclosure

The present disclosure is directed to the use of gel ink compositions in an indirect printing method.

2. Background

In direct printing machines, a marking material is applied directly to a final substrate to form the image on that substrate. Other types of printing machines use an indirect or offset printing technique. In indirect printing, the marking material is first applied onto an intermediate transfer member, and is subsequently transferred to a final substrate.

Gel inks are known for use in indirect printing processes. Examples of such gel inks are described in U.S. Pat. No. 7,767,011, issued Aug. 3, 2011. The gel inks in these processes are applied as a liquid to the intermediate transfer member and quickly gel. However, the gel remains wet, containing relatively large amounts of water and/or other liquid vehicles until it is transferred to the final substrate. After the gelled ink is transferred to the final substrate it is dried.

A need remains in the art for identification of ink compositions that can be employed in indirect printing methods in which the ink is substantially dried on the intermediate transfer member prior to transfer to the final substrate. Further, improvement in ink droplet circularity on the intermediate transfer member can enhance print quality and would also be a welcome step forward in the art.

SUMMARY

An embodiment of the present disclosure is directed to an indirect printing process for printing a gel ink. The process comprises providing a gel ink composition in an inkjet printing apparatus. Droplets of gel ink are ejected in an imagewise pattern onto an intermediate transfer member wherein each ink droplet forms a substantially circular image on the transfer member. The ink droplets are gelled and dried or solidified to form a substantially dry ink pattern on the intermediate transfer member. The substantially dry ink pattern is transferred from the intermediate transfer member to a final substrate.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present teachings.

Figure 1:
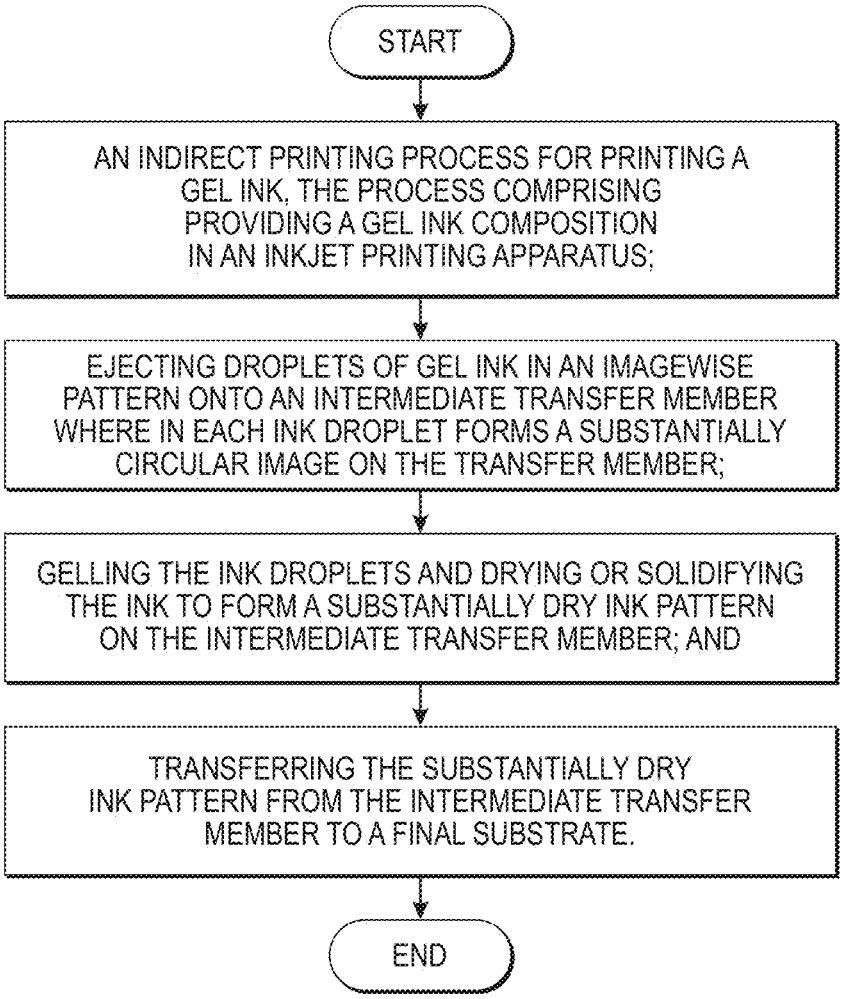
FIG. 1 shows a flow diagram of an indirect printing process, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawing that forms a part thereof, and in which is shown by way of illustration a specific exemplary embodiment in which the present teachings may be practiced. The following description is, therefore, merely exemplary.

Indirect Gel Ink Printing Process

FIG. 1 shows a flow diagram of an indirect printing process, according to an embodiment of the present disclosure. The process comprises providing a gel ink composition in an inkjet printing apparatus. Specific types of gel ink compositions that are suitable, including aqueous gel inks and non-aqueous gel inks, will be discussed in greater detail below.

Figure 2:
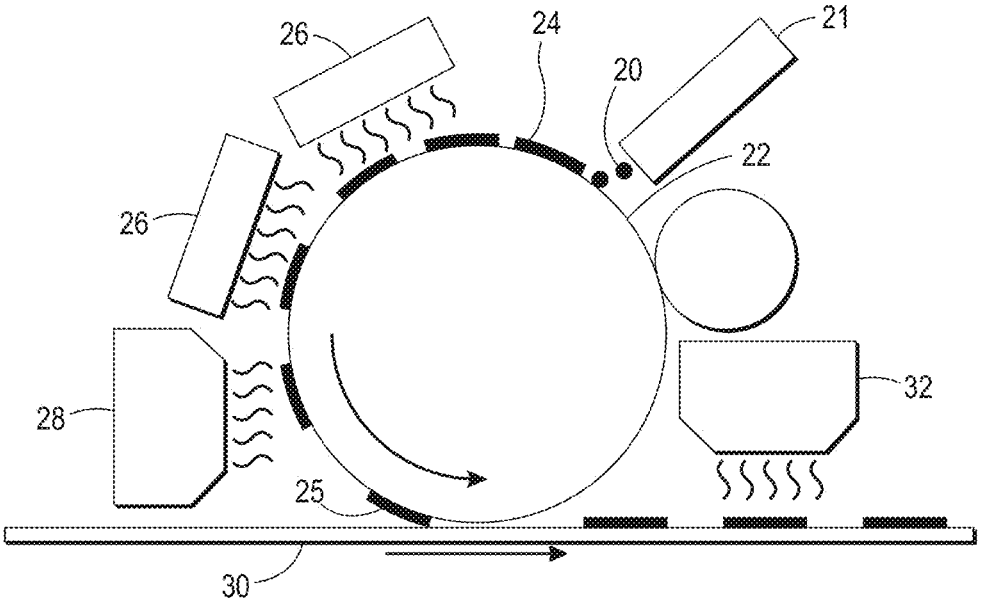
FIG. 2 illustrates a schematic view of an indirect printing device for printing gel inks, according to an embodiment of the present disclosure.

An example of an inkjet printing apparatus to which the ink can be provided is illustrated in FIG. 2. As shown in FIG. 2, droplets of liquid gel ink 20 can be ejected from an ink jet nozzle 21 in an imagewise pattern onto an intermediate transfer member 22. The transfer member can be a drum type member, as shown in FIG. 2. Alternatively, a belt type member can be employed as the intermediate transfer member, as is generally well known in the art.

The liquid ink spreads onto the intermediate transfer member 22 to form a transient ink pattern 24. In addition, the ink can pin and maintain a controlled substantially circular shape on the intermediate transfer member 22 by undergoing a phase change, such as partial or complete drying, solidification, gelation and/or thermal or photo-curing. This phase change can help to provide proper drop placement and image integrity. If further dot spread is desired, the transient image may optionally be heated before transfer to the final substrate.

The process of the present disclosure can result in improved circularity of the ink on the intermediate substrate compared with some other known ink jetting methods for jetting phase change inks. Generally speaking, degree of circularity can be determined by a number of different techniques. For purposes of this application, the term "circularity" is defined by the following formula:

$$C=p^2/(4\pi A) \quad (1)$$

where:

C=circularity p=perimeter length of ink droplet

A=area of ink droplet

A circularity of 1 as calculated by formula 1 denotes a perfectly circular droplet. Droplets of any other shape will have a circularity of greater than 1. Circularity as defined by formula 1 can be measured using an instrument known as PIAS (Personal Image Analysis System), which is sold by Quality Engineering Associates. The term "substantially circular" is defined herein to mean that the circularity, as determined by formula 1, ranges from about 0.9 to about 1.2. In an embodiment, the circularity can range from about 1 to about 1.1. The degree of circularity for a given ink can vary depending on a number of factors, including the substrate employed, among other things. In an embodiment, the average circularity of the ink drop surfaces can be about 1. In an embodiment, each ink drop on a given surface has circularity that deviates by less than 10% from each other.

Referring again to FIG. 2, thermal energy, radiation and/or some other form of energy can be applied to the ink in order to cause the desired phase change of the ink at one or more processing stations 26 and 28. Any number of heating stations and/or radiating stations can be employed. For example, heat can be applied at multiple stations 26 to dry the ink, followed by application of UV radiation to cure the ink at a radiating station 28. In another embodiment, a single heating station can be employed. In an alternative embodiment, thermal heating at one or more heating stations is applied without a further UV radiating step. In yet another embodiment, one or more UV radiating stations are employed to apply radiation without additional application of thermal energy from a heating station.

The above described application of energy to the gel inks of the present disclosure results in a substantially dry ink pattern 25 on the intermediate transfer member 22. Gelation can occur prior to or simultaneous with drying. In an embodiment, the substantially dry ink comprises less than 5% by weight water, based on the total weight of the dried ink before transfer to the final substrate. For example, the substantially dry ink can comprise less than 2%, or even less than 1% by weight water based on the total weight of the dried ink before transfer to the final substrate. Drying temperatures can range from about 40° to about 100° C., such as 50° C. to about 70° C. In an embodiment, gas flow can be used to carry water away during drying. In an embodiment, multiple stages of drying can be carried out at various temperatures, with first stages being below the boiling point of water or other solvent in the ink.

The substantially dry ink is then transferred from the intermediate transfer member 22 to a final substrate 30. Curing and/or further drying of the ink can then occur at station 32, if desired.

Gel Ink Compositions

The gel ink employed in the indirect printing processes of the present disclosure can be chosen to provide desired benefits. As discussed above, a suitable ink composition will allow droplets of gel ink to pin in place as they contact the intermediate substrate and quickly form high viscosity gel. In an embodiment, the droplets of gel ink remain circular as they contact the intermediate substrate.

Properties of the ink compositions, such as surface tension, particle size and viscosity can be chosen to be suitable for use in a piezoelectric inkjet printhead. Examples of surface tension values for the gel ink at a jetting temperature of 25° C. to 90° C. can be in the range of, for example, 15 to 50 mN/m, such as about 15 to about 40 mN/m, or about 20 to about 35 mN/m. Particle size can be less than 600 nm, such as about 50 nm to about 400 nm, or about 50 nm to about 300 nm. In an embodiment, the gel ink composition has a viscosity at a jetting temperature of 25° C. to 90° C. that ranges from about 3 to about 20 cps, such as about 4 cps to about 15 cps, or about 4 cps to about 12 cps, prior to ejecting from ink jet nozzle 21; and a viscosity of greater than about $1\times10^5$ cps and preferably greater than $1\times10^6$ cps on the intermediate transfer member 22 prior to transferring to the final substrate 30. In an embodiment, the gel ink has a viscosity less than 15 cps prior to ejecting and a viscosity greater than about $1\times10^6$ cps after being ejected onto the intermediate transfer substrate.

Additionally, the ink is designed to wet the intermediate receiving member to enable formation of the transient image as well as undergo a stimulus induced property change in order to enable release from the intermediate transfer member 22 in the transfer step.

Heterogeneous Gel Ink

In an embodiment, the gel ink composition is a heterogeneous gel ink. The heterogeneous gel ink comprises i) a colorant; ii) a polymer latex selected from the group consisting of a terpolymer latex and a styrene-n-butyl acrylate latex; iii) an optional dissipatable polymer; iv) a dispersant; and v) a liquid vehicle comprising water or non-aqueous solvent. The latex utilized in forming the ink composition is preferable a polymeric latex. In embodiments where the latex is a terpolymer latex, the terpolymer is preferably comprised of monomer units in a block or preferably random combination of the following formula:

A

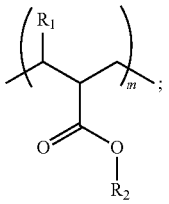

B

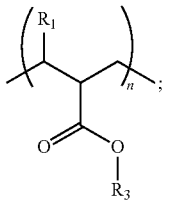

C

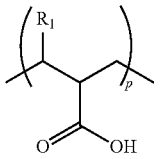

wherein A, B and C represent monomer units, m, n and p represent mole fractions of the respective monomer unit of the random terpolymer, each $R_1$ is independently a hydrogen or methyl group corresponding to the acrylate or methacrylate monomer, $R_2$ is a substituted or unsubstituted alkyl chain of from 1 to about 10 carbon atoms such as methyl, ethyl, propyl, butyl, or a substituted or unsubstituted phenyl group; and $R_3$ is an alkoxyl group of one or more oxygen atoms, such as ethylene oxide, polyethylene oxide having from 2 to about 10 or to about 20 ethylene oxide units or propylene oxide.

In the above formula for the terpolymer, A, B and C are preferably (meth)acrylate-based monomer species, which can be substituted or unsubstituted. As used herein, (meth) acrylate is used to refer to an acrylate or a methacrylate; thus, methyl(meth)acrylate refers to methyl acrylate or methyl methacrylate. Preferably, A represents a phenyl(meth)acrylate, B represents an alkoxyl(meth)acrylate where the alkoxyl group is —C—C—(O—C—C)$_3$, and C represents an acidic (meth)acrylate such as acrylic acid or methacrylic acid.

In the above formula for the terpolymer, n, m and p represent mole percent of the respective polymer units. Each of n, m and p is independently from about 0.1 to about 99.9 mole percent, which the sum n+m+p totaling 100, and preferably n is from about 30 to 50 mole percent, m is from about 10 to 50 mole percent and p is from about 1 to about 5 mole percent and provided that the sum of m, n and p is 100 mole percent of the terpolymer.

Any suitable styrene-n-butyl acrylate latex can be used. Examples of styrene-n-butyl acrylate latex can be found in U.S. patent application Ser. No. 14/067,469, filed Oct. 30, 2013, entitled INKJET INK CONTAINING POLYSTYRENE-CO-BUTYL ACRYLATE LATEX SUITABLE FOR INDIRECT PRINTING METHOD, the disclosure of which is hereby incorporated by reference in its entirety.

The latex is preferably provided in the form of a suspension or latex of the terpolymer in a suitable liquid, such as water. The latex can be provided, for example, with a solids content ranging from about 10 or 20 percent to about 60 or 70 percent, although about 30 to about 40 percent, or about 35 percent, is preferred.

The ink composition also optionally includes a dissipatable polymer, or humectant, which generally can be used to improve water retention at the printhead nozzle for improved jetting functionality, particularly after the printhead has been left idle for a long period of time. Examples of such dissipatable polymers include, but are not limited to, glycols and glycerine initiated polyether triols. Specific examples include, for example, propoxylated polyols, such as VORANOL® CP 450 polyol (a glycerine propoxylated polyether triol with an average molecular weight of 450) and VORANOL® CP 300 polyol (a glycerine propoxylated polyether triol with an average molecular weight of 300). A preferred dissipatable polymer in embodiments is VORANOL® 370, available from Dow Chemical Co., Midland, Mich. VORANOL® 370 is believed to be a mixture of one or more of the following:

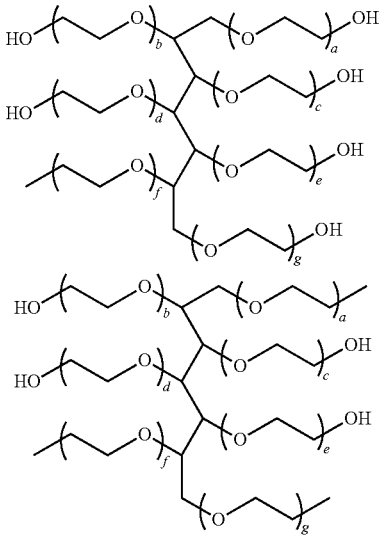

-continued

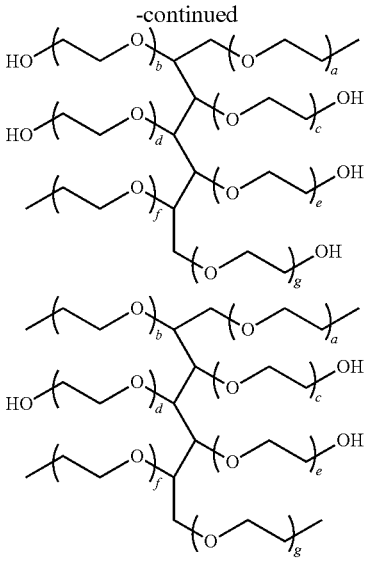

and any other possible mono-, di-, tri-, and tetravalent groups based on this VORANOL® (available from Dow Chemical Co., Midland, Mich.) central group, wherein a, b, c, d, e, f, and g are each integers representing the number of ethylene oxide repeat units and the molecular weight of the starting material (wherein all end groups are terminated by hydroxy groups) is about 1,040.

The ink composition also preferably contains a dispersant and/or surface active additive to assist in dispersing the other ink components in the liquid vehicle. Examples of the dispersant that can be used include, but are not limited to, water soluble polymers, such as polyvinyl alcohol, methyl cellulose, ethyl cellulose, hydroxyethyl cellulose, carboxymethyl cellulose, polysodium acrylate and polysodium methacrylate; an anionic surfactant, such as sodium dodecylbenzenesulfonate, sodium octadecylsulfate, sodium oleate, sodium laurate and potassium stearate; a cationic surfactant, such as laurylamine acetate, stearylamine acetate and lauryltrimethylammonium chloride; an amphoteric surfactant, such as lauryldimethylamine oxide; a nonionic surfactant, such as polyoxyethylene alkyl ether, polyoxyethylene alkylphenyl ether and polyoxyethylene alkylamine; an inorganic salt, such as tricalcium phosphate, aluminum hydroxide, calcium sulfate, calcium carbonate and barium carbonate; mixtures thereof; and the like. In some preferred embodiments, the dispersant is a polyester, preferably a sulfonated polyester.

In embodiments, the polymeric or high molecular weight dispersant selected for the ink composition can be added in amounts either to provide its stabilizing action, or in higher amounts. Thus, for example, the component can be added in higher proportions than required for stabilizing the ink, thereby acting as a viscosity modifier.

When a polyester is used as the dispersant, the polyester dispersant is most preferably a sulfonated polyester. The sulfonated polyester may be formed from any suitable acid and alcohol. Preferably, the polyester is derived from one or more terephthalates and one or more glycols. For example, the polyester may be derived from a reaction that includes, for example, three glycol components. In an embodiment herein, the polyester is a sulfonated polyester derived from a reaction of dimethylterephthalate, sodium dimethyl 5-sulfoisophthalate, propanediol, diethylene glycol and dipropylene glycol.

Additional examples of sulfonated polyesters which may be used in the present invention include those illustrated in U.S. Pat. Nos. 5,593,807 and 5,945,245, the disclosures of which are totally incorporated herein by reference, for example including sodium sulfonated polyester, and more specifically, a polyester such as poly(1,2-propylene-sodio 5-sulfoisophthalate), poly(neopentylene-sodio 5-sulfoisophthalate), poly(diethylene-sodio 5-sulfoisophthalate), copoly (1,2-propylene-sodio 5-sulfoisophthalate)-copoly-(1,2-propylene-terephthalate-phthalate), copoly(1,2-propylene-diethylene-sodio 5-sulfoisophthalate)-copoly-(1,2-propylene-diethylene-terephthalate-phthalate), copoly (ethylene-neopentylene-sodio 5-sulfoisophthalate)-copoly-(ethylene-neopentylene-terephthalate-phthalate), and copoly (propoxylated bisphenol A)-copoly-(propoxylated bisphenol A-sodio 5-sulfoisophthalate).

The sulfonated polyesters may in embodiments be represented by the following formula, or random copolymers thereof wherein the n and p segments are separated:

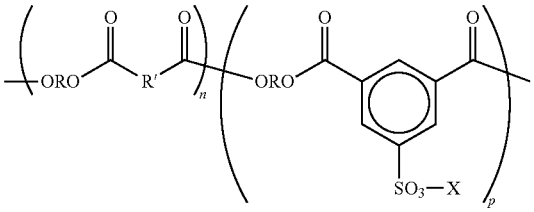

wherein R is selected from the group consisting of alkylene units, propylene glycol units, diethylene glycol units and dipropylene glycol units, or mixtures thereof, where the alkylene units can be, for example, from 2 to about 25 carbon atoms, such as ethylene, propylene, butylene, oxyalkylene diethyleneoxide, and the like; R' is an arylene of, for example, from about 6 to about 36 carbon atoms, such as a benzylene, bisphenylene, bis(alkyloxy)bisphenolene, and the like; X represents a suitable counterion, such as an alkali metal such as sodium; and p and n represent the mole percent of the respective randomly repeating segments, such that the overall polymer contains from about 10 to about 20,000 repeating segments. The alkali sulfopolyester possesses, for example, a number average molecular weight (Mn) of from about 1,500 to about 50,000 grams per mole and a weight average molecular weight (Mw) of from about 6,000 grams per mole to about 150,000 grams per mole as measured by gel permeation chromatography and using polystyrene as standards. Preferably, n and p in the above formula are selected to represent mole percent of from about 1 to about 99, such as from about 3 or about 5 to about 95 or about 97, such that n+p=100. Preferably, in embodiments, n is about 96 mole percent and p is about 4 mole percent.

The ink composition also includes a liquid vehicle. The liquid vehicle can include one or more of water or a solvent such as a diol or a polyol or a blend of water with a water soluble cosolvent. Cosolvents that have limited solubility in water can also be used if a solubilizer third cosolvent is used to produce a homogeneous vehicle. The liquid vehicle helps to ensure that the ink composition remains in a stable, liquid state at room temperature (typically about 20° C.), but transforms to a gel state upon heating and/or upon removal of some of the water or liquid content. If desired, the liquid vehicle can be provided either as entirely water, entirely diol and/or polyol (except for any water that may be present in the latex component), or a combination of water and diol and/or polyol.

When a diol and/or a polyol is included, the selected liquid or mixture of liquids is chosen to be compatible with the other ink components, and can be either polar or nonpolar in nature. Specific examples of suitable liquids include polar liquids such as glycol ethers, esters, amides, alcohols, and the like, with specific examples including butyl carbitol, tripropylene glycol monomethyl ether, 1-phenoxy-2-propanol, dibutyl phtholate, dibutyl sebacate, 1-dodecanol, and the like, as well as mixtures thereof. Other suitable examples include ethylene glycol, diethylene glycol, triethylene glycol, dimethylolpropionic acid, sucrose, polytetramethylene glycol (MW <about 3000 g/mol), polypropylene glycol (MW<about 3000 g/mol), polyester polyols (MW<about 3000 g/mol), polyethylene glycol (MW<about 3000 g/mol), pentaerythritol, triethanol amine, glycerin, 1,6-hexanediol, N-methyl-N,N-diethanol amine, trimethylol propane, N,N,N',N'-tetrakis(2-hydroxypropyl)ethethylenediamine, and the like. In some preferred embodiments, diethylene glycol is employed.

The liquid vehicle component is present in the ink in any desired or effective amount. In one embodiment, the liquid vehicle component is present in an amount of from about 5 to about 60 percent by weight of the ink; in another embodiment the liquid vehicle component is present in an amount of from about 10 to about 55 percent by weight of the ink; and in yet another embodiment the liquid vehicle component is present in an amount of from about 20 to about 50 percent by weight of the ink. However, amounts outside of these ranges can be used, as desired.

The ink compositions also contain a colorant, preferably a self-dispersible colorant. Any desired or effective colorant can be employed in the inks, including dyes, pigments, mixtures thereof, and the like, provided that the colorant can be dissolved or dispersed in the ink vehicle. The carrier compositions can be used in combination with conventional ink colorant materials, such as Color Index (C.I.) Solvent Dyes, Disperse Dyes, modified Acid and Direct Dyes, Basic Dyes, Sulphur Dyes, Vat Dyes, and the like. Examples of suitable dyes include Neozapon Red 492 (BASF); Orasol Red G (Ciba-Geigy); Direct Brilliant Pink B (Crompton & Knowles); Aizen Spilon Red C-BH (Hodogaya Chemical); Kayanol Red 3BL (Nippon Kayaku); Levanol Brilliant Red 3BW (Mobay Chemical); Levaderm Lemon Yellow (Mobay Chemical); Spirit Fast Yellow 3G; Aizen Spilon Yellow C-GNH (Hodogaya Chemical); Sirius Supra Yellow GD 167; Cartasol Brilliant Yellow 4GF (Sandoz); Pergasol Yellow CGP (Ciba-Geigy); Orasol Black RLP (Ciba-Geigy); Savinyl Black RLS (Sandoz); Dermacarbon 2GT (Sandoz); Pyrazol Black BG (ICI); Morfast Black Conc. A (Morton-Thiokol); Diaazol Black RN Quad (ICI); Orasol Blue GN (Ciba-Geigy); Savinyl Blue GLS (Sandoz); Luxol Blue MBSN (Morton-Thiokol); Sevron Blue 5GMF (ICI); Basacid Blue 750 (BASF), Neozapon Black X51 [C.I. Solvent Black, C.I. 12195] (BASF), Sudan Blue 670 [C.I. 61554] (BASF), Sudan Yellow 146 [C.I. 12700] (BASF), Sudan Red 462 [C.I. 26050] (BASF), Intratherm Yellow 346 from Crompton and Knowles, C.I. Disperse Yellow 238, Neptune Red Base NB543 (BASF, C.I. Solvent Red 49), Neopen Blue FF-4012 from BASF, Lampronol Black BR from ICI (C.I. Solvent Black 35), Morton Morplas Magenta 36 (C.I. Solvent Red 172), metal phthalocyanine colorants such as those disclosed in U.S. Pat. No. 6,221,137, the disclosure of which is totally incorporated herein by reference, and the like. Polymeric dyes can also be used, such as those disclosed in, for example, U.S. Pat. Nos. 5,621,022 and 5,231,135, the disclosures of each of which are totally incorporated herein by reference, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactant Orange X-38, uncut Reactant Blue X-17, and uncut Reactant Violet X-80.

Pigments are also suitable colorants for the inks. Examples of suitable pigments include Violet Toner VT-8015 (Paul Uhlich); Paliogen Violet 5100 (BASF); Paliogen Violet 5890 (BASF); Permanent Violet VT 2645 (Paul Uhlich); Heliogen Green L8730 (BASF); Argyle Green XP-1,1-S (Paul Uhlich); Brilliant Green Toner GR 0991 (Paul Uhlich); Lithol Scarlet D3700 (BASF); Toluidine Red (Aldrich); Scarlet for Thermoplast NSD PS PA (Ugine Kuhlmann of Canada); E.D. Toluidine Red (Aldrich); Lithol Rubine Toner (Paul Uhlich); Lithol Scarlet 4440 (BASF); Bon Red C (Dominion Color Company); Royal Brilliant Red RD-8192 (Paul Uhlich); Oracet Pink RF (Ciba-Geigy); Paliogen Red 3871 K (BASF); Paliogen Red 3340 (BASF); Lithol Fast Scarlet L4300 (BASF); Heliogen Blue L6900, L7020 (BASF); Heliogen Blue K6902, K6910 (BASF); Heliogen Blue D6840, D7080 (BASF); Sudan Blue OS (BASF); Neopen Blue FF4012 (BASF); PV Fast Blue B2G01 (American Hoechst); Irgalite Blue BCA (Ciba-Geigy); Paliogen Blue 6470 (BASF); Sudan III (Red Orange) (Matheson, Colemen Bell); Sudan II (Orange) (Matheson, Colemen Bell); Sudan Orange G (Aldrich), Sudan Orange 220 (BASF); Paliogen Orange 3040 (BASF); Ortho Orange OR 2673 (Paul Uhlich); Paliogen Yellow 152, 1560 (BASF); Lithol Fast Yellow 0991 K (BASF); Paliotol Yellow 1840 (BASF); Novoperm Yellow FGL (Hoechst); Permanent Yellow YE 0305 (Paul Uhlich); Lumogen Yellow D0790 (BASF); Suco-Yellow L1250 (BASF); Suco-Yellow D 1355 (BASF); Suco Fast Yellow D1355, D1351 (BASF); Hostaperm Pink E (American Hoechst); Fanal Pink D4830 (BASF); Cinquasia Magenta (Du Pont); Paliogen Black L0084 (BASF); Pigment Black K801 (BASF); and carbon blacks such as REGAL 330® (Cabot), Carbon Black 5250, Carbon Black 5750 (Columbia Chemical), IJX-157 (Cabot) and the like.

Other ink colors besides the subtractive primary colors can be desirable for applications such as postal marking or industrial marking and labeling, and the invention is applicable to these needs. Further, infrared (IR) or ultraviolet (UV) absorbing dyes can also be incorporated into the inks for use in applications such as "invisible" coding or marking of products. Examples of such infrared and ultraviolet absorbing dyes are disclosed in, for example, U.S. Pat. Nos. 5,378,574, 5,146,087, 5,145,518, 5,543,177, 5,225,900, 5,301,044, 5,286,286, 5,275,647, 5,208,630, 5,202,265, 5,271,764, 5,256,193, 5,385,803, and 5,554,480, the disclosures of each of which are totally incorporated herein by reference.

The colorant is present in the ink in any desired or effective amount to obtain the desired color or hue. Typically, the colorant is present in the ink in an amount of least about 0.1 percent by weight of the ink, preferably at least about 0.2 percent by weight of the ink, and more preferably at least about 0.5 percent by weight of the ink, and typically no more than about 50 percent by weight of the ink, preferably no more than about 20 percent by weight of the ink, and more preferably no more than about 10 percent by weight of the ink. However, the amount can be outside of these ranges depending on specific printing needs.

The heterogeneous gel ink compositions preferably have a final solids content that is greater than about 10% by weight. Advantageously, the ink compositions can have a solids content of greater than about 15% by weight, and even more preferably greater than about 20% by weight. The ink compositions also preferably have a final water content that is less than about 80% by weight. Advantageously, the ink compositions can have a water content of less than about 70% by weight, and even more preferably less than about 60% by weight.

In embodiments, the proportion of solid additives in the ink composition is selected to provide an ink composition that provides a phase transition from a liquid state to a gel state at an elevated temperature above ambient temperature. Thus, for example, the ink composition exhibits a phase transition from a liquid state to a gel state at a temperature of not less than about 30° C., and preferably not less than about 40° C. or not less than about 50° C.

Example heterogeneous gel ink formulations can be formed by mixing carbon black (CAB-O-JET available from Cabot, 14.9% solution), Voranol 370 available from Dow Chemicals, diethylene glycol available from Aldrich, a sulfonated polyester. An example of the sulfonated polyester has the formula:

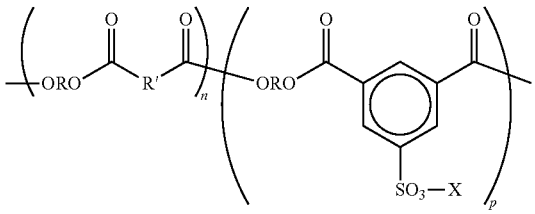

wherein R is a mixture of propylene glycol units, diethylene glycol units and dipropylene glycol units, n is 96 mole % and p is 4 mole %; and R' and X are defined as above in the description of this same formula.

After the components are homogeneously mixed together, a latex can be added while stirring with a magnetic stirrer. An example latex is a phenyl methacrylate terpolymer latex, such as a random terpolymer of the following formula:

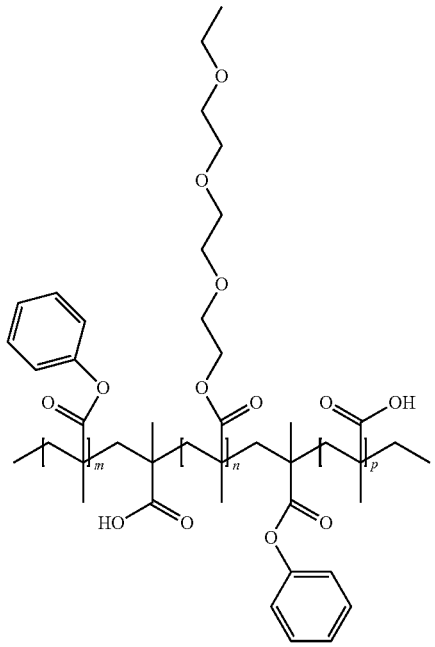

where n is from about 30 to 50 mol %, m is from about 10 to 50 mol % and p is from about 1 to about 5 mol %.

The ink compositions are stable liquids at ambient temperature, but form high viscosity gels at high temperatures (about 60° C.). These inks can form a gel solution upon impacting an intermediate transfer member that is heated above 60° C. Alternatively, the inks may contain a styrene-n butyl acrylate latex or an amorphous and/or crystalline polyester latex.

Examples of heterogeneous gel inks and methods of making the same were previously described in U.S. Pat. Nos. 7,172,276 and 7,202,883, the disclosures of which are incorporated herein by reference in their entirety.

Low Temperature Gel Ink

In an embodiment, the gel ink composition is an aqueous low temperature gel ink. The aqueous low temperature gel ink comprises: i) a colorant; ii) a gelling agent; iii) an electrolyte; iv) a polymer latex selected from the group consisting of an amorphous polyester latex, a crystalline polyester latex, a terpolymer latex and a styrene-n-butyl acrylate latex; and v) a liquid vehicle comprising water.

The colorant, polymer latex and liquid vehicle carrier ingredients can be the same or similar to those discussed above for the heterogeneous gel ink compositions, although the amounts of the ingredients used may be different. For example, the solids content can be slightly less in some embodiments, such as at least 7% by weight based on the total gel ink composition. Further, the water content, while still within the ranges discussed above for the liquid vehicle, may be greater than, for example, about 20 wt %, in the low temperature gel inks, although less water can be used in some embodiments.

Any suitable gelling agents can be employed. Examples of gelling agents include, but are not limited to, agar, algin, carrageenan, fucoidan, laminaran, gum Arabic, corn hull gum, gum ghatti, guar gum, karaya gum, locust bean gum, pectin dextrans, starches, carboxymethylcellulose, polyvinyl alcohol, gellan gum, xanthum gum, iota-carrageenan, and methylcellulose.

A preferred gelling agent is a low acyl gellan gum, commercially available as KELCOGEL AFT® (manufactured by CP Kelco, Chicago, Ill.). The structure is as follows:

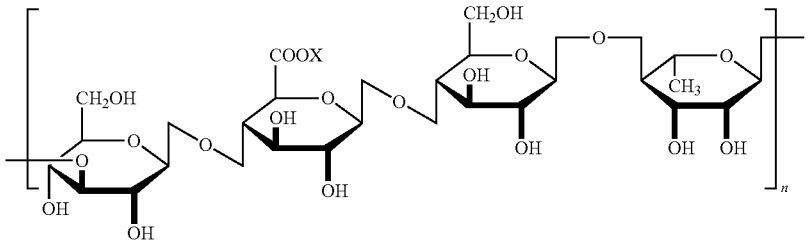

Where n is the number of repeating units and X represents a counterion that may be, but is not limited to, sodium, potassium, lithium, magnesium or calcium. Molecular weight for the polymer can range, for example, from about $2\times10^5$ to about $3\times10^5$ daltons.

The gelling agent is present in an amount from about 0.001 to about 5 percent by weight of the ink, preferably in an amount from about 0.01 to about 3 percent by weight of the ink, and more preferably in an amount from about 0.1 to about 2.5 percent by weight of the ink.

In order to improve the gelling action, an electrolyte can be added to the ink. In this context the electrolyte is defined as any ionic or covalent compound that dissolves to give solutions that contain ions. Examples of suitable electrolytes for purposes herein include, but are not limited to, sodium, potassium or lithium salts of polystyrenesulfonate and its copolymers, preferably sodium salts, buffers such as tris(hydroxymethyl)aminomethane hydrochloride TRIZMAHCL® available from Sigma Aldrich.

Other polyelectrolytes suitable for use herein include, but are not limited to, salts of polymeric carboxylic acids such as those described in U.S. Pat. No. 5,539,038, column 4, line 23 to 41, the disclosure of which is included herein by reference in its entirety. Also suitable are sulphonated polyesters such as those disclosed in U.S. Pat. No. 7,172,276, the disclosure of which is included herein by reference in its entirety. Additional examples of sulfonated polyesters which may be used in the present invention include those illustrated in U.S. Pat. Nos. 5,593,807 and 5,945,245, the disclosures of which are totally incorporated herein by reference, for example including sodium sulfonated polyester, and more specifically, a polyester such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), and copoly (propoxylated bisphenol A)-copoly-(propoxylated bisphenol A-sodio 5-sulfoisophthalate).

The electrolyte is preferably present in the ink in the range of about 0.01 weight % to about 20.0 weight %, preferably from about 0.1 to about 5 weight % and more preferably from about 0.1 to about 2.5 weight %. The ratio of gelling agent to electrolyte is about 1.5:1 to about 4:1, and preferably about 2:1 to about 3:1.

Preferably the electrolyte is made by the stable free radical polymerization process as disclosed in U.S. Pat. No. 6,156,858, incorporated herein in its entirety by reference. Examples of electrolytes made by the stable free radical polymerization process suitable for purposes herein include, but are not limited to derivatives of styrenes, acrylates, styrene acrylates, styrene butadienes, esters, and the like. Specific examples include polystyrenesulfonate, and its copolymers, including styrenesulfonate copolymerized with one or more of the following but not limited to n-butyl acrylate, methylmethacrylate, styrene, butadiene, isoprene, α-hexene (and/or other higher α-olefins), vinylchloride, ethylacrylate, acrylic acid, methacrylic acid, crotonic acid, acrylonitrile, acrylamide, N-methylacrylamide and the like.

Preferably, the electrolyte is a polystyrenesulfonate having the following structure:

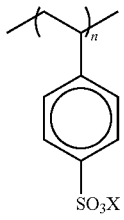

where X represents a counterion and n represents the number of repeating units. The counterion of the polystyrenesulfonate may be, but is not limited to, for example, sodium, potassium, lithium, magnesium or calcium. A monovalent counterion such as sodium is preferred. The molecular weight can range from about 5000 to 50,000 g/mole. In an embodiment, n can range from about 5 to about 2000, such as about 5 to about 250 or 500.

Suitable for use herein are polystyrene sulfonate polymers, obtained by free radical polymerization having a weight average molecular weight in the range of about 1,000 g/mole to about 200,000 g/mole, preferably from about 2,000 to about 100,000 g/mole. Especially preferable are polystyrene sulfonates obtained by the stable free radical polymerization processes (SFRP-PSS). The SFRP-PSS preferably has a weight average molecular weight in the range of about 2,000 g/mole to about 100,000 g/mole, preferably from about 10,000 to about 20,000 g/mole with a polydispersity (ratio of weight to number average molecular weight) of less than 2.0, preferably less than 1.5.

Preparing the electrolyte using the stable free radical polymerization process as described in U.S. Pat. No. 6,156,858 allows the gel ink to comprise a block copolymer. Another block or blocks of the block copolymer are prepared using the stable free radical polymerization process and are bonded to the electrolyte produced by this process. Preferably, the other block or blocks of the block copolymer that are not derivatives of styrene sulfonate are film forming polymer resins. This allows the gel ink to have film forming properties that could not be as easily achieved using an electrolyte prepared by a different method. For aqueous inks, polymer latex particles having film forming properties are often used, examples are disclosed in U.S. Pat. No. 7,172,276, incorporated herein by reference in its entirety.

This technique permits the preparation of a wide range of different materials which are either difficult to prepare, or not available with other polymerization processes. For example, the architecture or topology of the polymer (i.e., comb, star, dendritic, etc.), composition of the backbone (i.e., random, gradient, or block copolymer), inclusion of functionality (i.e., chain end, site specific, etc.) can all be readily manipulated using free radical methodologies while still retaining a high degree of control over the molecular weight and polydispersity.

Each type of block in a block copolymer shows the behavior (e.g., crystallinity, melting temperature, glass transition temperature, etc.) present in the corresponding homopolymer as long as the block lengths are not too short. This offers the ability to combine the properties of two very different polymers into one block copolymer, i.e., an electrolyte and a film forming polymer is possible. This provides the advantage of homogeneity, i.e., the two additives combined into one are more able to remain monophasic instead of risking the possibility of incompatible additives that prefer being biphasic.

For example, the general formula of a block copolymer comprising a preferred polystyrenesulfonate is:

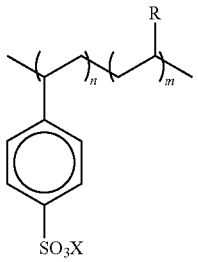

where X can be, for example, Na or Li, n and m can be the same or different and can range from about 5 to about 2000, such as about 5 to about 250 or 500, where n+m is less than or equal to 2000, and R is an alkyl group such as methyl, ethyl, propyl, butyl or any $C_nH_{2n+1}$ group.

The stable free radical polymerization process can be used to prepare random copolymers, block copolymers and multiblock copolymers. Block copolymers are preferred herein. The mole proportions of the monomers in the block copolymers can be of any values, the restriction being that the resulting block copolymer must be soluble or dispersable in the ink of the invention. Blends of homopolymers and copolymers are also suitable.

In an embodiment, the inks are gels at ambient (room) temperature, or a sufficiently low temperature, and liquids at elevated temperatures. In order to affect the sol-gel temperature the concentration of a polyelectrolyte additive, such as polystyrenesulfonate (PSS), can be modified.

In an embodiment, the structure of polystyrenesulfonate is as follows:

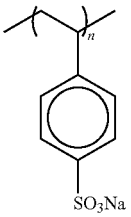

In an embodiment, n can range from about 5 to about 2000, such as about 5 to about 250 or 500. The PSS made through SFRP (stable free radical polymerization) gives the ink more desirable properties for jetting. Preferred are SFRP PSS of a polydispersity of about 1.4 and a Mn of ~10,300 g/mol. The molecular weight of the PSS and the amount of gelling materials are adjusted so that the viscosity at room temperature is greater than 300 cps while the viscosity at temperatures greater than 35° C. is about 5 to about 10 cps.

Examples of aqueous low temperature gel inks and methods of making the same are described in U.S. Pat. No. 7,767,011, the disclosure of which is incorporated herein by reference in its entirety.

Radiation Curable Gel Ink

In an embodiment, the gel ink composition is a radiation curable gel ink composition. The radiation curable gel ink composition comprises: i) a colorant; ii) a gelling agent; iii) a radiation curable carrier; iv) a wax; and v) a photoinitiator.

As the at least one gellant, compounds of the formula

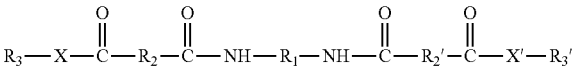

may be used wherein:

$R_1$ is:

(i) an alkylene group (wherein an alkylene group is defined as a divalent aliphatic group or alkyl group, including linear and branched, saturated and unsaturated, cyclic and acyclic, and substituted and unsubstituted alkylene groups, and wherein heteroatoms, such as oxygen, nitrogen, sulfur, silicon, phosphorus, boron, and the like either may or may not be present in the alkylene group), with from, for example, 1 to about 20 carbon atoms in the alkylene chain, such as from 1 to about 12 or from 1 to about 4 carbon atoms, (ii) an arylene group (wherein an arylene group is defined as a divalent aromatic group or aryl group, including substituted and unsubstituted arylene groups, and wherein heteroatoms, such as oxygen, nitrogen, sulfur, silicon, phosphorus, boron, and the like either may or may not be present in the arylene group), with from, for example, about 5 to about 20 carbon atoms in the arylene chain, such as from about 6 to about 14 or from about 6 to about 10 carbon atoms, (iii) an arylalkylene group (wherein an arylalkylene group is defined as a divalent arylalkyl group, including substituted and unsubstituted arylalkylene groups, wherein the alkyl portion of the arylalkylene group can be linear or branched, saturated or unsaturated, and cyclic or acyclic, and wherein heteroatoms, such as oxygen, nitrogen, sulfur, silicon, phosphorus, boron, and the like either may or may not be present in either the aryl or the alkyl portion of the arylalkylene group), with from, for example, about 6 to about 32 carbon atoms in the arylalkylene chain, such as from about 7 to about 22 or from about 7 to about 20 carbon atoms, or (iv) an alkylarylene group (wherein an alkylarylene group is defined as a divalent alkylaryl group, including substituted and unsubstituted alkylarylene groups, wherein the alkyl portion of the alkylarylene group can be linear or branched, saturated or unsaturated, and cyclic or acyclic, and wherein heteroatoms, such as oxygen, nitrogen, sulfur, silicon, phosphorus, boron, and the like either may or may not be present in either the aryl or the alkyl portion of the alkylarylene group), with from, for example, about 6 to about 32 carbon atoms in the alkylarylene chain, such as from about 7 to about 22 or from about 7 to about 20 carbon atoms, wherein the substituents on the substituted alkylene, arylene, arylalkylene, and alkylarylene groups can be, for example, halogen atoms, cyano groups, pyridine groups, pyridinium groups, ether groups, aldehyde groups, ketone groups, ester groups, amide groups, carbonyl groups, thiocarbonyl groups, sulfide groups, nitro groups, nitroso groups, acyl groups, azo groups, urethane groups, urea groups, mixtures thereof, and the like, wherein two or more substituents can be joined together to form a ring;

$R_2$ and $R_2'$ each, independently of the other, are:

(i) alkylene groups (wherein an alkylene group is defined as a divalent aliphatic group or alkyl group, including linear and branched, saturated and unsaturated, cyclic and acyclic, and substituted and unsubstituted alkylene groups, and wherein heteroatoms, such as oxygen, nitrogen, sulfur, silicon, phosphorus, boron, and the like either may or may not be present in the alkylene group), with from, for example, 1 to about 54 carbon atoms in the alkylene chain, such as from 1 to about 44 or from 1 to about 36 carbon atoms, (ii) arylene groups (wherein an arylene group is defined as a divalent aromatic group or aryl group, including substituted and unsubstituted arylene groups, and wherein heteroatoms, such as oxygen, nitrogen, sulfur, silicon, phosphorus, boron, and the like either may or may not be present in the arylene group), with from, for example, 5 to about 14 carbon atoms in the arylene chain, such as from 6 to about 14 or from 7 to about 10 carbon atoms, (iii) arylalkylene groups (wherein an arylalkylene group is defined as a divalent arylalkyl group, including substituted and unsubstituted arylalkylene groups, wherein the alkyl portion of the arylalkylene group can be linear or branched, saturated or unsaturated, and cyclic or acyclic, and wherein heteroatoms, such as oxygen, nitrogen, sulfur, silicon, phosphorus, boron, and the like either may or may not be present in either the aryl or the alkyl portion of the arylalkylene group), with from, for example, about 6 to about 32 carbon atoms in the arylalkylene chain, such as from about 7 to about 22 or from 8 to about 20 carbon atoms, or (iv) alkylarylene groups (wherein an alkylarylene group is defined as a divalent alkylaryl group, including substituted and unsubstituted alkylarylene groups, wherein the alkyl portion of the alkylarylene group can be linear or branched, saturated or unsaturated, and cyclic or acyclic, and wherein heteroatoms, such as oxygen, nitrogen, sulfur, silicon, phosphorus, boron, and the like either may or may not be present in either the aryl or the alkyl portion of the alkylarylene group), with from, for example, about 6 to about 32 carbon atoms in the alkylarylene chain, such as from about 7 to about 22 or from about 7 to about 20 carbon atoms, wherein the substituents on the substituted alkylene, arylene, arylalkylene, and alkylarylene groups can be, for example, halogen atoms, cyano groups, ether groups, aldehyde groups, ketone groups, ester groups, amide groups, carbonyl groups, thiocarbonyl groups, phosphine groups, phosphonium groups, phosphate groups, nitrile groups, mercapto groups, nitro groups, nitroso groups, acyl groups, acid anhydride groups, azide groups, azo groups, cyanato groups, urethane groups, urea groups, mixtures thereof, and the like, wherein two or more substituents can be joined together to form a ring;

$R_3$ and $R_3'$ each, independently of the other, are either:

(a) photoinitiating groups, such as groups derived from 1-(4-(9-hydroxyethoxy)phenyl)-2-hydroxy-2-methylpropan-1-one, of the formula

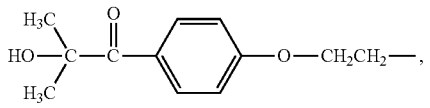

groups derived from 1-hydroxycyclohexylphenylketone, of the formula

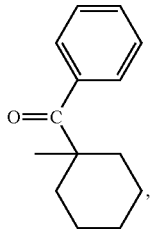

groups derived from 2-hydroxy-2-methyl-1-phenylpropan-1-one, of the formula

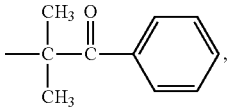

groups derived from N,N-dimethylethanolamine or N,N-dimethylethylenediamine, of the formula

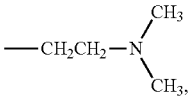

or the like, or:

(b) a group which is:

(i) an alkyl group (including linear and branched, saturated and unsaturated, cyclic and acyclic, and substituted and unsubstituted alkyl groups, and wherein heteroatoms, such as oxygen, nitrogen, sulfur, silicon, phosphorus, boron, and the like either may or may not be present in the alkyl group), with from, for example, about 2 to 100 carbon atoms in the alkyl chain, such as from about 3 to about 60 or from about 4 to about 30 carbon atoms, (ii) an aryl group (including substituted and unsubstituted aryl groups, and wherein heteroatoms, such as oxygen, nitrogen, sulfur, silicon, phosphorus, boron, and the like either may or may not be present in the aryl group), with from, for example, about 5 to about 100 carbon atoms on the aryl chain, such as from about 5 to about 60 or from about 6 to about 30 carbon atoms, such as phenyl or the like, (iii) an arylalkyl group (including substituted and unsubstituted arylalkyl groups, wherein the alkyl portion of the arylalkyl group can be linear or branched, saturated or unsaturated, and cyclic or acyclic, and wherein heteroatoms, such as oxygen, nitrogen, sulfur, silicon, phosphorus, boron, and the like either may or may not be present in either the aryl or the alkyl portion of the arylalkyl group), with from, for example, about 6 to about 100 carbon atoms on the arylalkyl chain, such as from 6 to about 60 or from about 7 to about 30 carbon atoms, such as benzyl or the like, or (iv) an alkylaryl group (including substituted and unsubstituted alkylaryl groups, wherein the alkyl portion of the alkylaryl group can be linear or branched, saturated or unsaturated, and cyclic or acyclic, and wherein heteroatoms, such as oxygen, nitrogen, sulfur, silicon, phosphorus, boron, and the like either may or may not be present in either the aryl or the alkyl portion of the alkylaryl group), with from, for example, about 6 to about 100 carbon atoms in the alkylaryl chain, such as from about 6 to about 60 or from about 7 to about 30 carbon atoms, such as tolyl or the like, wherein the substituents on the substituted alkyl, arylalkyl, and alkylaryl groups can be, for example, halogen atoms, ether groups, aldehyde groups, ketone groups, ester groups, amide groups, carbonyl groups, thiocarbonyl groups, sulfide groups, phosphine groups, phosphonium groups, phosphate groups, nitrile groups, mercapto groups, nitro groups, nitroso groups, acyl groups, acid anhydride groups, azide groups, azo groups, cyanato groups, isocyanato groups, thiocyanato groups, isothiocyanato groups, carboxylate groups, carboxylic acid groups, urethane groups, urea groups, mixtures thereof, and the like, wherein two or more substituents can be joined together to form a ring;

and X and X' each, independently of the other, is an oxygen atom or a group of the formula —$NR_4$—, wherein $R_4$ is:

(i) a hydrogen atom;

(ii) an alkyl group, including linear and branched, saturated and unsaturated, cyclic and acyclic, and substituted and unsubstituted alkyl groups, and wherein heteroatoms either may or may not be present in the alkyl group, with from, for example, 1 to about 100 carbon atom in the alkyl chain, such as from 1 to about 60 or from 1 to about 30 carbon atoms, (iii) an aryl group, including substituted and unsubstituted aryl groups, and wherein heteroatoms either may or may not be present in the aryl group, with from, for example, about 5 to about 100 carbon atoms in the aryl chain, such as from about 5 to about 60 or about 6 to about 30 carbon atoms, (iv) an arylalkyl group, including substituted and unsubstituted arylalkyl groups, wherein the alkyl portion of the arylalkyl group can be linear or branched, saturated or unsaturated, and cyclic or acyclic, and wherein heteroatoms either may or may not be present in either the aryl or the alkyl portion of the arylalkyl group, with from, for example, about 6 to about 100 carbon atoms in the arylalkyl group, such as from about 6 to about 60 or from about 7 to about 30 carbon atoms, or (v) an alkylaryl group, including substituted and unsubstituted alkylaryl groups, wherein the alkyl portion of the alkylaryl group can be linear or branched, saturated or unsaturated, and cyclic or acyclic, and wherein heteroatoms either may or may not be present in either the aryl or the alkyl portion of the alkylaryl group, with from, for example, about 6 to about 100 carbon atoms in the alkylaryl chain, such as from about 6 to about 60 or from about 7 to about 30 carbon atoms, wherein the substituents on the substituted alkyl, aryl, arylalkyl, and alkylaryl groups can be, for example, halogen atoms, ether groups, aldehyde groups, ketone groups, ester groups, amide groups, carbonyl groups, thiocarbonyl groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, azo groups, cyanato groups, isocyanato groups, thiocyanato groups, isothiocyanato groups, carboxylate groups, carboxylic acid groups, urethane groups, urea groups, mixtures thereof, and the like, wherein two or more substituents can be joined together to form a ring.

In one specific embodiment, $R_2$ and $R_2'$ are the same as each other; in another specific embodiment, $R_2$ and $R_2'$ are different from each other. In one specific embodiment, $R_3$ and $R_3'$ are the same as each other; in another specific embodiment, $R_3$ and $R_3'$ are different from each other.

In one specific embodiment, $R_2$ and $R_2'$ are each groups of the formula —$C_{34}H_{56+a}$— and are branched alkylene groups which may include unsaturations and cyclic groups, wherein a is an integer of 0, 1, 2, 3, 4, 5, 6, 7, 8, 9, 10, 11, or 12, including, for example, isomers of the formula

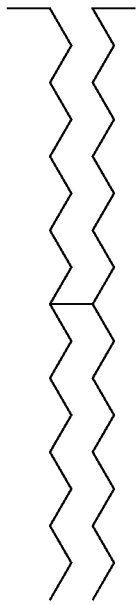

In one specific embodiment, $R_1$ is an ethylene (—$CH_2CH_2$—) group.

In one specific embodiment, at least one of $R_3$ and $R_3'$ is of the formula

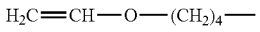

In another specific embodiment, at least one of $R_3$ and $R_3'$ is of the formula

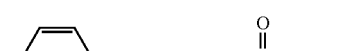

In yet another specific embodiment, at least one of $R_3$ and $R_3'$ is of the formula

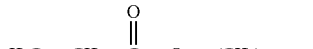

In still another specific embodiment, at least one of $R_3$ and $R_3'$ is of the formula

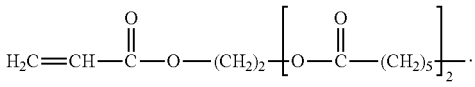

In another specific embodiment, at least one of $R_3$ and $R_3'$ is of the formula

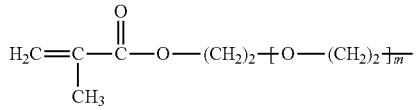

wherein m is an integer representing the number of repeating [O—$(CH_2)_2$] units, and is in one specific embodiment 2 and is in another specific embodiment 5.

In yet another specific embodiment, at least one of $R_3$ and $R_3'$ is of the formula

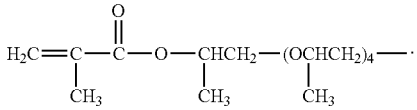

In one specific embodiment, at least one of $R_3$ and $R_3'$ is

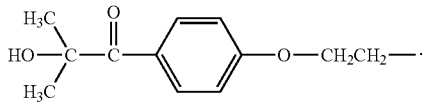

In embodiments, the gellant is of the formula

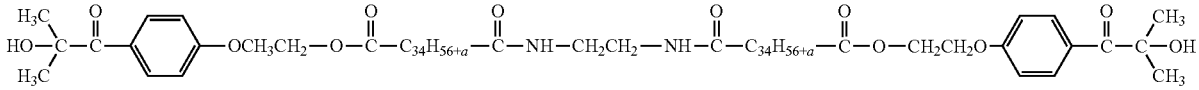

wherein —$C_{34}H_{56+a}$— represents a branched alkylene group which may include unsaturations and cyclic groups, wherein a is an integer of 0, 1, 2, 3, 4, 5, 6, 7, 8, 9, 10, 11, or 12, including, for example, isomers of the formula

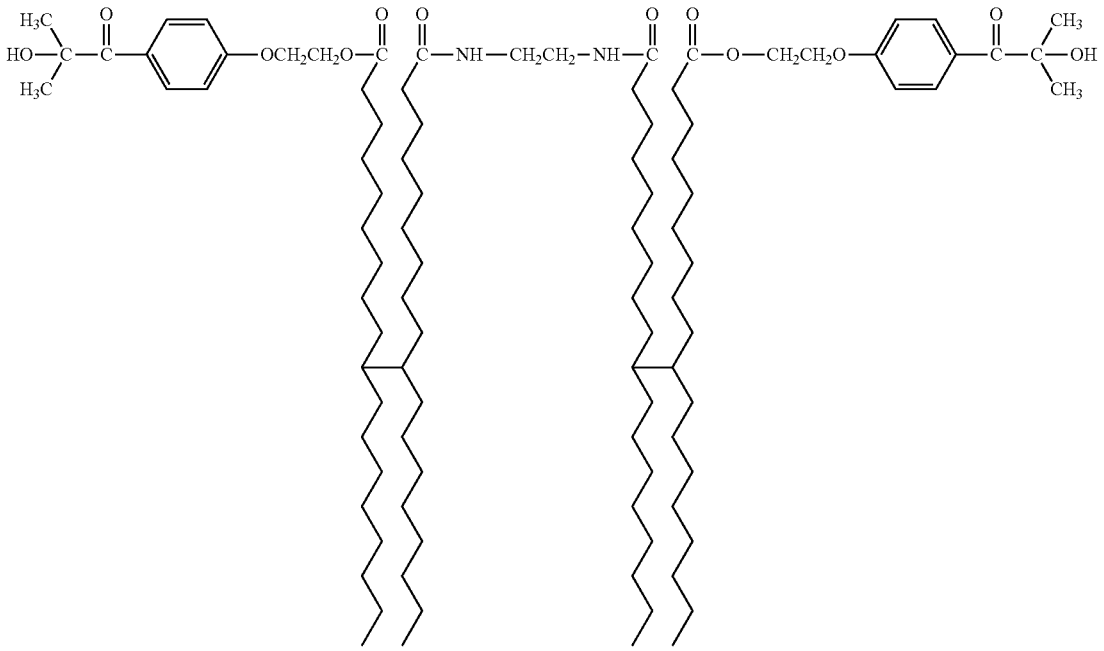
Additional specific examples of gellants of this formula include those of the formula
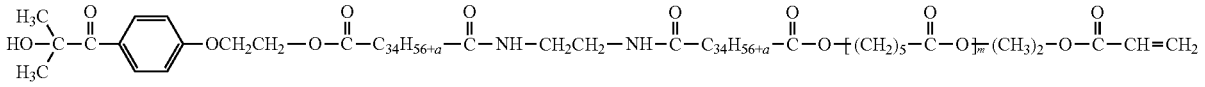
wherein —$C_{34}H_{56+a}$— represents a branched alkylene group which may include unstaturations and cyclic groups, wherein a is an integer of 0, 1, 2, 3, 4, 5, 6, 7, 8, 9, 10, 11, or 12, and wherein m is an integer, for example including embodiments wherein m is 2, including isomers of the formula
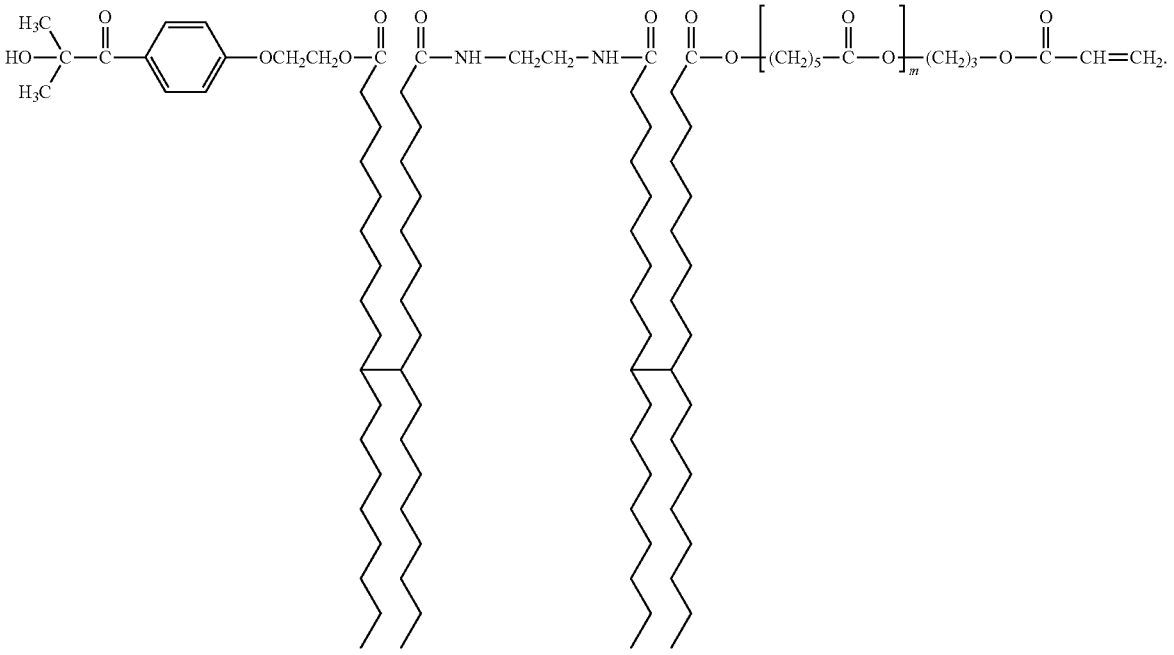

those of the formula
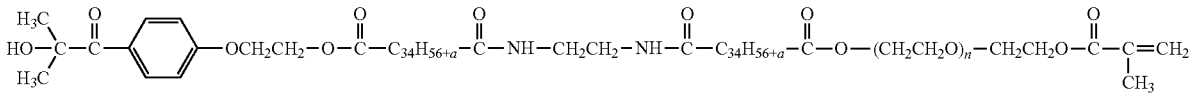
wherein —$C_{34}H_{56+a}$— represents a branched alkylene group which may include unsaturations and cyclic groups, wherein a is an integer of 0, 1, 2, 3, 4, 5, 6, 7, 8, 9, 10, 11, or 12 and wherein n is a integer, for example including embodiments wherein n is 2 and wherein n is 5, including for example, isomers of the formula
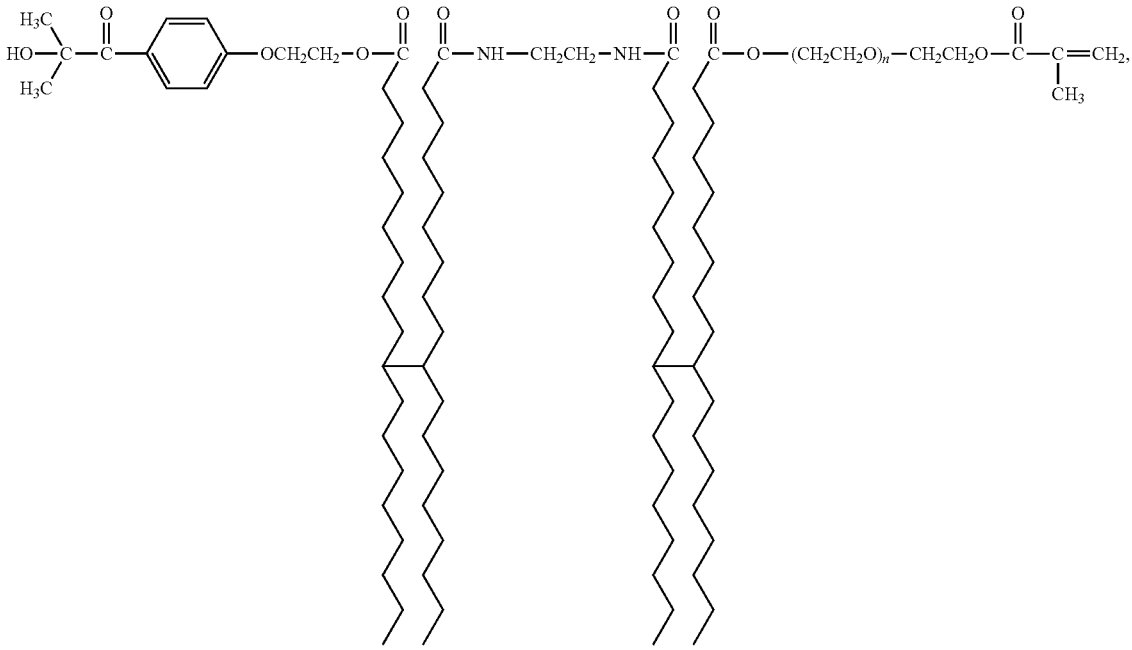
those of the formula
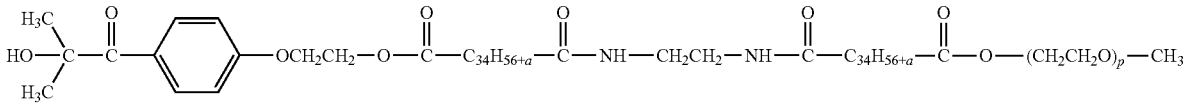

wherein —$C_{34}H_{56+a}$— represents a branched alkylene group which may include unsaturations and cyclic groups, wherein a is an integer of 0, 1, 2, 3, 4, 5, 6, 7, 9, 10, 11, or 12 and wherein p is an integer, for example including embodiments wherein p is 2 and wherein p is 3, for example including isomers of the formula

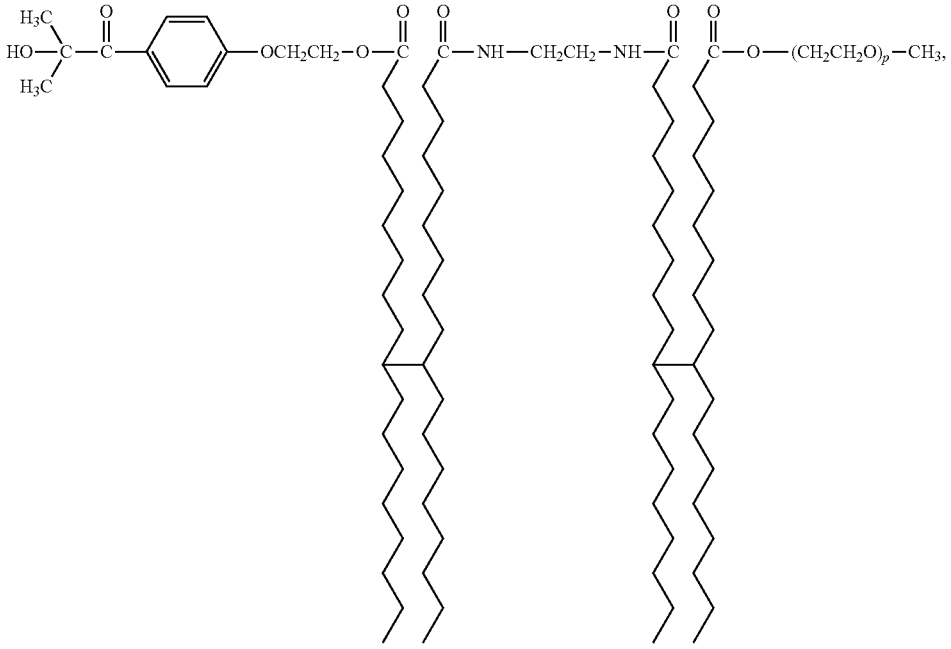

those of the formula

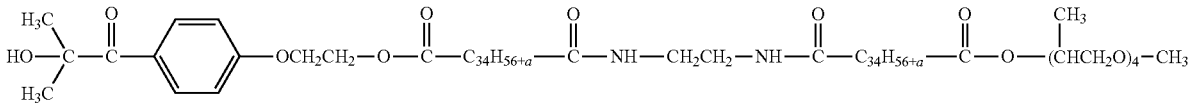

wherein —$C_{34}H_{56+a}$— represents a branched alkylene group which may include unsaturations and cyclic groups, wherein a is an integer of 0, 1, 2, 3, 4, 5, 6, 7, 8, 9, 10, 11, or 12 and wherein q is an integer, for example including embodiments wherein q is 2 and wherein q is 3, including for example, isomers of the formula

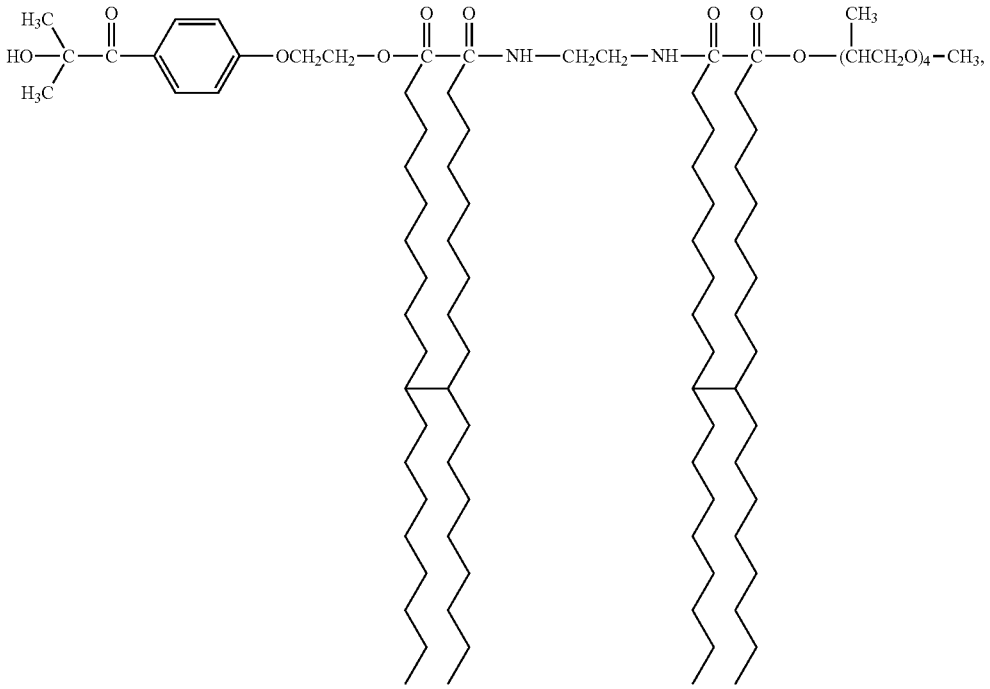
those of the formula
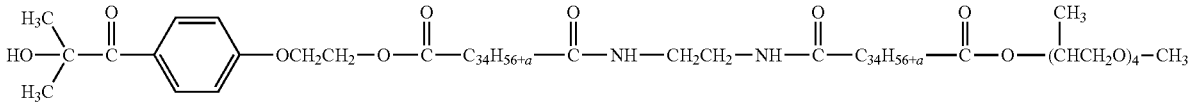
wherein —$C_{34}H_{56+a}$— represents a branched alkylene group which may include unsaturations and cyclic groups, wherein a is an integer of 0, 1, 2, 3, 4, 5, 6, 7, 8, 9, 10, 11, or 12 and wherein r is an integer, for example including embodiments wherein r is 2 and wherein r is 3, including for example, isomers of the formula

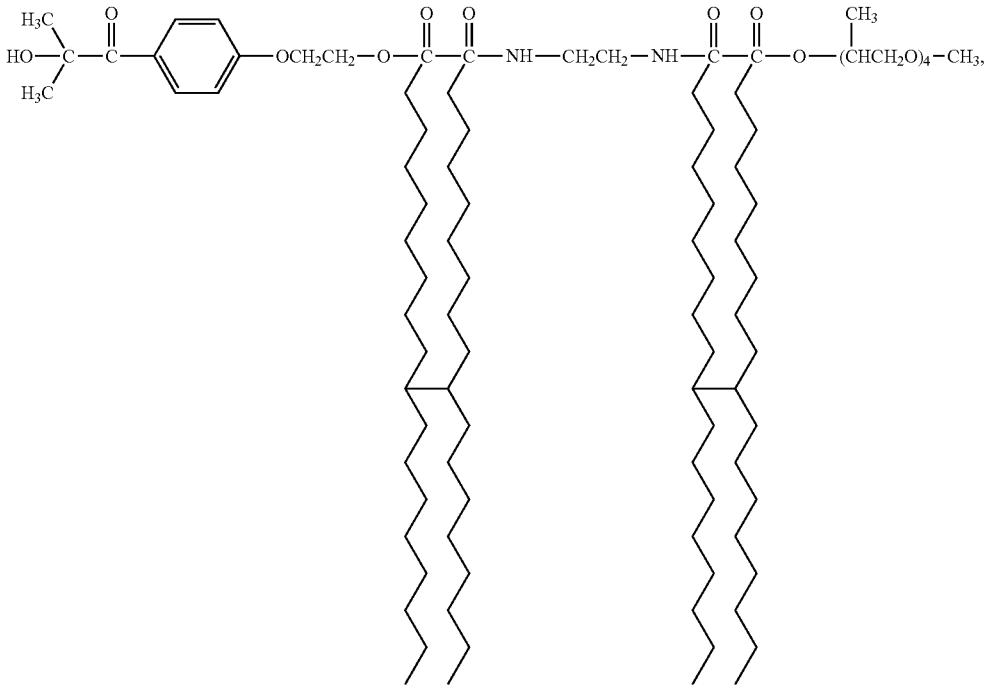

and the like, as well as mixtures thereof.

In embodiments, the gellant is a mixture, including a mixture of all three, of

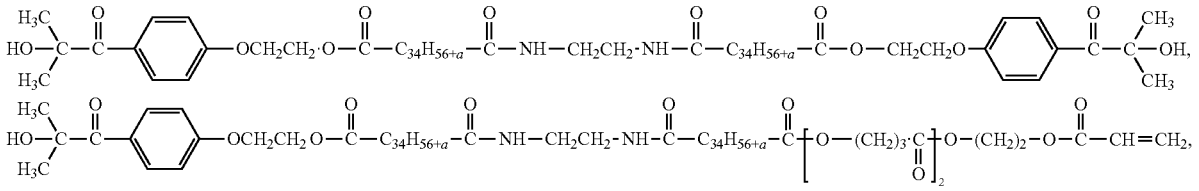

and

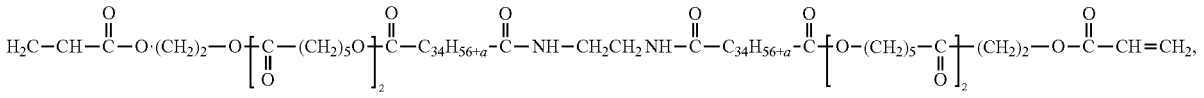

wherein —$C_{34}H_{56}+_3$- represents a branched alkylene group which may include unsaturations and cyclic groups, wherein a is an integer of 0, 1, 2, 3, 4, 5, 6, 7, 8, 9, 10, 11, or 12.

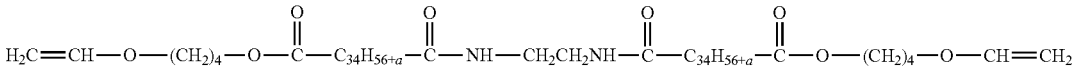

Desirably, when all three compounds are used together as the gellant, the compounds are present in molar ratios of about 1:2:1 with respect to the first listed above: second listed above: third listed above.

Additional specific examples of suitable gellant compounds of the general formula above include those of the formula wherein —$C_{34}H_{56+a}$— represents a branched alkylene group which may include unsaturations and cyclic groups, wherein a is an integer of 0, 1, 2, 3, 4, 5, 6, 7, 8, 9, 10, 11, or 12, including isomers of the formula

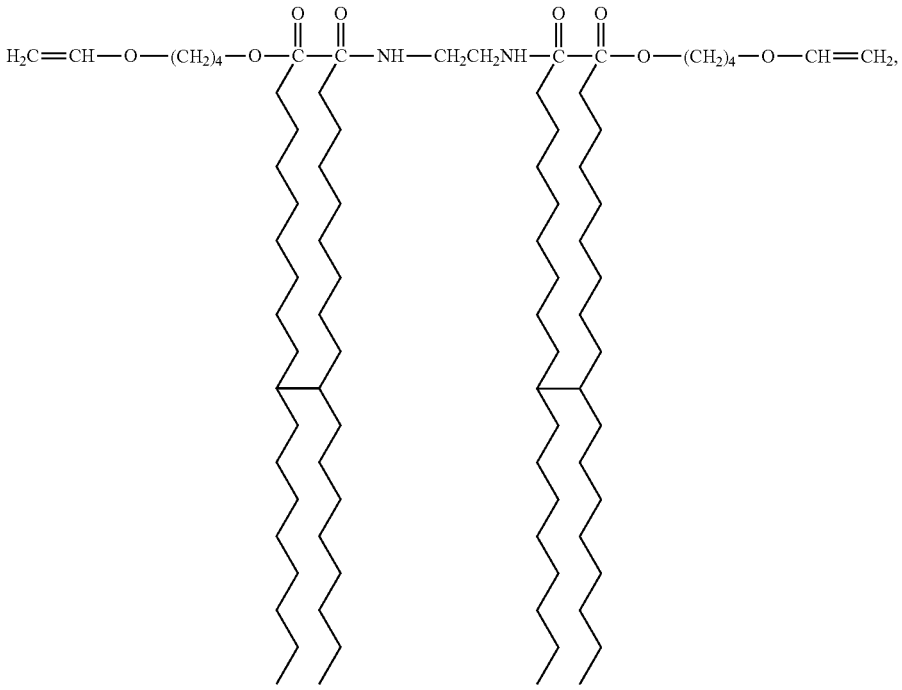
those of the formula
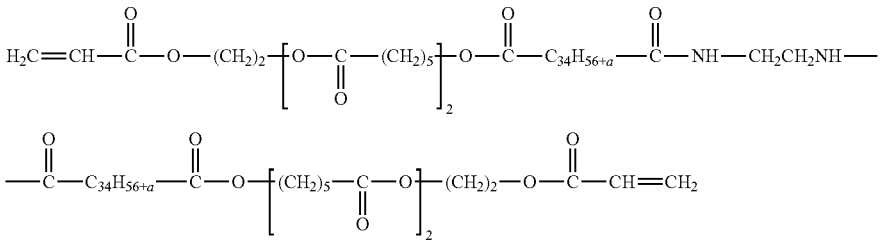
wherein —$C_{34}H_{56}+_3$- represents a branched group which may include unsaturations and cyclic groups, wherein a is an integer of 0, 1, 2, 3, 4, 5, 6, 7, 8, 9, 10, 11, or 12, including isomers of the formula

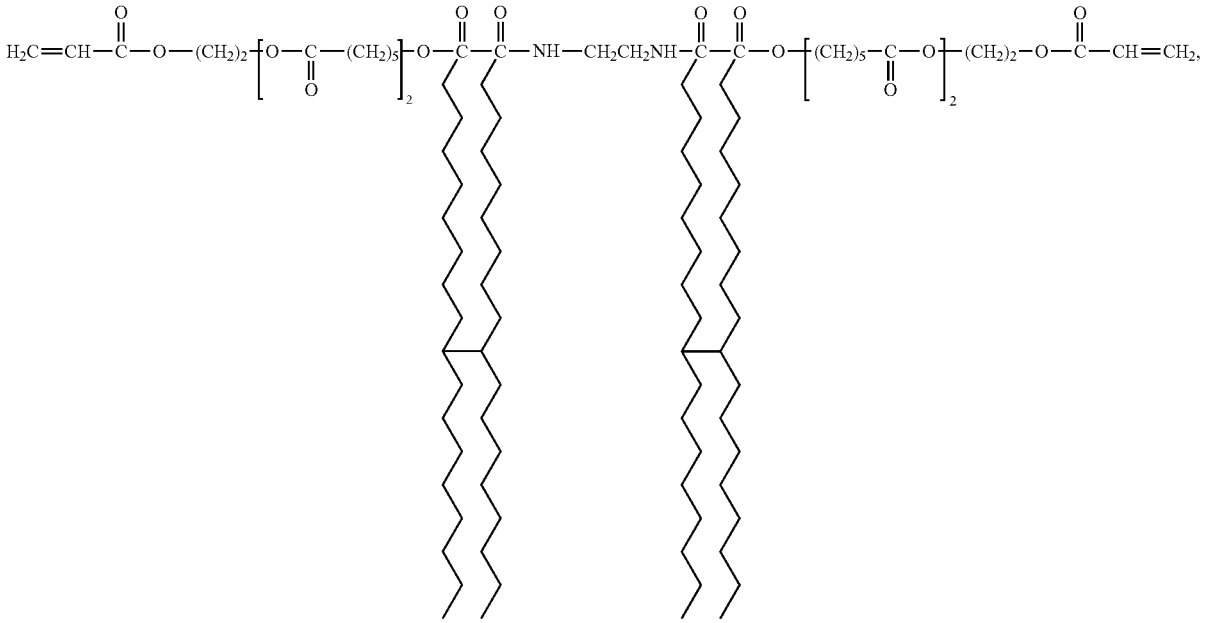

as well as mixtures thereof.

As the at least one carrier, examples of a suitable ink carrier materials include curable monomer compounds, such as acrylate, methacrylate, alkene, vinyl ether, allylic ether, epoxide and oxetane compounds and mixtures thereof. Specific examples of relatively nonpolar acrylate and methacrylate monomers include, for example, isobornyl acrylate, isobornyl methacrylate, lauryl acrylate, lauryl methacrylate, isodecylacrylate, isodecylmethacrylate, caprolactone acrylate, 2-phenoxyethyl acrylate, isooctylacrylate, isooctylmethacrylate, butyl acrylate, and the like, as well as mixtures thereof. In addition, multifunctional acrylate and methacrylate monomers and oligomers can be included in the phase change ink carrier as reactive diluents and as materials that can increase the crosslink density of the cured image, thereby enhancing the toughness of the cured images. Examples of suitable multifunctional acrylate and methacrylate monomers and oligomers include pentaerythritol tetraacrylate, pentaerythritol tetramethacrylate, 1,2-ethylene glycol diacrylate, 1,2-ethylene glycol dimethacrylate, 1,6-hexanediol diacrylate, 1,6-hexanediol dimethacrylate, 1,12-dodecanol diacrylate, 1,12-dodecanol dimethacrylate, tris(2-hydroxy ethyl)isocyanurate triacrylate, propoxylated neopentyl glycol diacrylate (available from Sartormer Co. Inc. as SR9003), hexanediol diacrylate, tripropylene glycol diacrylate, dipropylene glycol diacrylate, amine modified polyether acrylates (available as PO 83 F, LR 8869, and/or LR 8889 (all available from BASF Corporation), trimethylolpropane triacrylate, glycerol propoxylate triacrylate, dipentaerythritol pentaacrylate, dipentaerythritol hexaacrylate, ethoxylated pentaerythritol tetraacrylate (available from Sartomer Co. Inc. as SR 494), and the like, as well as mixtures thereof.

When a reactive diluent is added to the ink carrier material, the reactive diluent is added in any desired or effective amount, in one embodiment from about 1 percent by weight of the carrier to about 80 percent by weight of the carrier, and in another embodiment from about 1 percent by weight of the carrier to about 70 percent by weight of the carrier, and in yet another embodiment from about 35 percent by weight of the carrier to about 70 percent by weight of the carrier.

The ink carrier is present in the phase change ink in any desired or effective amount, in one embodiment from about 0.1 percent by weight of the ink to about 98 percent by weight of the ink, in another embodiment from about 50 percent by weight of the ink to about 98 percent by weight of the ink, and in yet another embodiment from about 90 percent by weight of the ink to about 95 percent by weight of the ink.

The phase change ink further contains at least one wax. The wax can be curable or non-curable. The wax may be any wax component that is miscible with the other ink components. Inclusion of the wax promotes an increase in viscosity of the ink as it cools from the jetting temperature.

Desirably, the wax composition is curable so as to participate in the curing of the ink. Suitable examples of UV curable waxes include those that are functionalized with curable groups. The curable groups may include, for example, acrylate, methacrylate, alkene, allylic ether, epoxide and/or oxetane groups. These waxes can be synthesized by the reaction of a wax equipped with a transformable functional group, such as carboxylic acid, hydroxyl and the like. The functionalized wax is also able to participate in the ultraviolet light initiated cure and thus does not lower the final robustness of the image. Additionally, the wax acts as a binder, preventing syneresis, and in printing, acts as a barrier or coating on paper/image receiving substrate, preventing the principle carrier from wicking or showing through the paper. The curable wax also reduces haloing tendency.

Suitable examples of hydroxyl-terminated polyethylene waxes that may be functionalized with a curable group include, for example, mixtures of carbon chains with the structure $CH_3—(CH_2)_n—CH_2OH$, where there is a mixture of chain lengths, n, where the average chain length is for example in the range of about 16 to about 50, and linear low molecular weight polyethylene, of similar average chain length. Suitable examples of such waxes include, for example, UNILIN® 350, UNILIN® 425, UNILIN® 550 and UNILIN® 700 with Mn approximately equal to 375, 460, 550 and 700 g/mol, respectively. All of these waxes are commercially available from Baker-Petrolite. Other suitable examples include alcohols of the formula $CH_3(CH_2)$ $_nCH_2OH$, where n=20-50. Guerbet alcohols, characterized as 2,2-dialkyl-1-ethanols, are also suitable compounds. For example, Guerbet alcohols include those containing 16 to 36 carbons, many of which are commercially available from Jarchem Industries Inc., Newark, N.J. PRIPOL® 2033 (C-36 dimer diol mixture including isomers of the formula

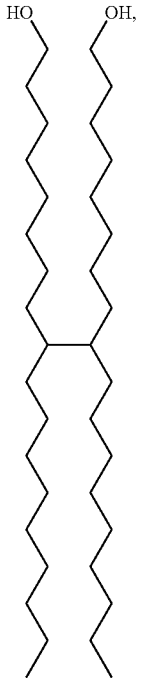

as well as other branched isomers which may include unsaturations and cyclic groups, available from Uniqema, New Castle, Del.; further information on C36 dimer diols of this type is disclosed in, for example, "Dimer Acids," Kirk-Othmer Encyclopedia of Chemical Technology, Vol. 8, 4th Ed. (1992), pp. 223 to 237, the disclosure of which is totally incorporated herein by reference) can also be used. These alcohols can be reacted with carboxylic acids equipped with UV curable moieties to form reactive esters. Examples of these acids include, for example, acrylic and methacrylic acids, available from Sigma-Aldrich Co. Particularly suitable curable moieties include acrylates of UNILIN® 350, UNILIN® 425, UNILIN® 550 and UNILIN® 700.

Suitable examples of carboxylic acid-terminated polyethylene waxes that may be functionalized with a curable group include, for example, mixtures of carbon chains with the structure $CH_3$—$(CH_2)_n$—COOH, where there is a mixture of chain lengths, n, where the average chain length is, for example, from about 16 to about 50, and linear low molecular weight polyethylene, of similar average chain length. Suitable examples of such waxes include, for example, UNICID® 350, UNICID® 425, UNICID® 550 and UNICID® 700 with Mn equal to approximately 390, 475, 565 and 720 g/mol, respectively. Other suitable examples have a structure $CH_3$—$(CH_2)_n$—COOH, such as hexadecanoic or palmitic acid with n=14, heptadecanoic or margaric or daturic acid with n=15, octadecanoic or stearic acid with n=16, eicosanoic or arachidic acid with n=18, docosanoic or behenic acid with n=20, tetracosanoic or lignoceric acid with n=22, hexacosanoic or cerotic acid with n=24, heptacosanoic or carboceric acid with n=25, octacosanoic or montanic acid with n=26, triacontanoic or melissic acid with n=28, dotriacontanoic or lacceroic acid with n=30, tritriacontanoic or ceromelissic or psyllic acid, with n=31, tetratriacontanoic or geddic acid with n=32, pentatriacontanoic or ceroplastic acid with n=33. Guerbet acids, characterized as 2,2-dialkyl ethanoic acids, are also suitable compounds. For example, Guerbet acids include those containing 16 to 36 carbons, many of which are commercially available from Jarchem Industries Inc., Newark, N.J. PRIPOL® 1009 (C-36 dimer acid mixture including isomers of the formula

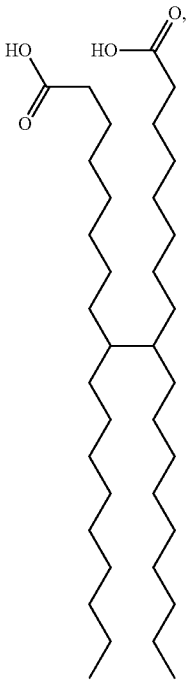

as well as other branched isomers which may include unsaturations and cyclic groups, available from Uniqema, New Castle, Del.; further information on C36 dimer acids of this type is disclosed in, for example, "Dimer Acids," Kirk-Othmer Encyclopedia of Chemical Technology, Vol. 8, 4th Ed. (1992), pp. 223 to 237, the disclosure of which is totally incorporated herein by reference) can also be used. These carboxylic acids can be reacted with alcohols equipped with UV curable moieties to form reactive esters. Examples of these alcohols include, for example, 2-allyloxyethanol and 1,4-butanediol vinyl ether, both available from Sigma-Aldrich Co.; alcohols of

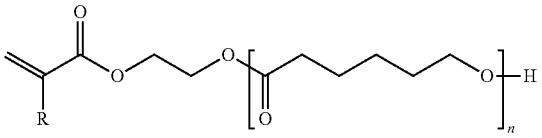

available as TONE M-101 (R—H, $n_{avg}$=1), TONE M-100 (R—H, $n_{avg}$=2) and TONE M-201 (R=Me, $n_{avg}$=1) from The Dow Chemical Company; and

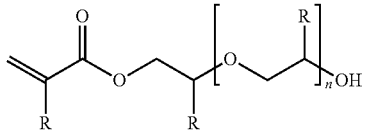

CD572 (R—H, n=10) and SR604 (R=Me, n=4) from Sartomer Company, Inc.

Other suitable examples of curable waxes include, for example, AB2 diacrylate hydrocarbon compounds that may be prepared by reacting AB2 molecules with acryloyl halides, and then further reacting with aliphatic long-chain, monofunctional aliphatic compounds. Suitable functional groups useful as A groups in embodiments include carboxylic acid groups and the like. Suitable functional groups useful as B groups in embodiments may be hydroxyl groups, thiol groups, amine groups, amide groups, imide groups, phenol groups, and mixtures thereof. Exemplary AB2 molecules include, for example, bishydroxy alkyl carboxylic acids (AB2 molecules in which A is carboxylic acid and B is hydroxyl), 2,2-bis(hydroxymethyl) butyric acid, N,N-bis(hydroxyethyl) glycine, 2,5-dihydroxybenzyl alcohol, 3,5-bis(4-aminophenoxy)benzoic acid, and the like. Exemplary AB2 molecules also include those disclosed in Jikei et al. (Macromolecules, 33, 6228-6234 (2000)).

In embodiments, the acryloyl halide may be chosen from acryloyl fluoride, acryloyl chloride, acryloyl bromide, and acryloyl iodide, and mixtures thereof. In particular embodiments, the acryloyl halide is acryloyl chloride.

Exemplary methods for making AB2 molecules may include optionally protecting the B groups first. Methods for protecting groups such as hydroxyls will be known to those of skill in the art. An exemplary method for making AB2 molecules such as 2,2-bis(hydroxylmethyl)proprionic acid is the use of benzaldehyde dimethyl acetal catalyzed by a sulfonic acid such as p-toluene sulfonic acid in acetone at room temperature to form benzylidene-2,2-bis(oxymethyl)proprionic acid. This protected AB2 molecule may be subsequently coupled with an aliphatic alcohol. Suitable aliphatic alcohols include stearyl alcohol; 1-docosanol; hydroxyl-terminated polyethylene waxes such as mixtures of carbon chains with the stricture $CH_3$—$(CH_2)_n$—$CH_2OH$, where there is a mixture of chain lengths, n, having an average chain length, in some embodiments, in the range of about 12 to about 100; and linear low molecular weight polyethylenes that have an average chain length similar to that of the described hydroxyl-terminated polyethylene waxes. Suitable examples of such waxes include, but are not limited to, UNILIN 350, UNILIN 425, UNILIN 550 and UNILIN 700 with Mn approximately equal to 375, 460, 550 and 700 g/mol, respectively. All of these waxes are commercially available from Baker-Petrolite. Guerbet alcohols, characterized as 2,2-dialkyl-1-ethanols, are also suitable compounds. In particular embodiments, the Guerbet alcohols may be chosen from Guerbet alcohols containing 16 to 36 carbon atoms; many such Guerbet alcohols are commercially available from Jarchem Industries Inc., Newark, N.J.

The acid group of the AB2 monomer may be esterified by the aliphatic alcohol using p-toluenesulfonic acid in refluxing toluene. Following the reaction of the aliphatic alcohol with the protected AB2 monomer, the protecting groups may be removed in methylene chloride using a palladium carbon catalyst under hydrogen gas. Once deprotected, the final product diacrylate aliphatic ester may be made using acryloyl chloride in methylene chloride with pyridine or triethylamine.

The curable wax is preferably included in the ink in an amount of from, for example, in one embodiment about 0.1% to about 50% by weight of the ink, in another embodiment from about 0.5% to about 40%, and in a further embodiment from about 1% to 30%.

The phase change inks further contain at least one initiator. Examples of suitable initiators include benzophenones, benzyl ketones, monomeric hydroxyl ketones, polymeric hydroxyl ketones, α-amino ketones, acyl phosphine oxides, metallocenes, benzoin ethers, benzyl ketals, α-hydroxyalkylphenones, α-aminoalkylphenones, acylphosphine photoinitiators sold under the trade designations of IRGACURE and DAROCUR from BASF, arylsulphonium salts, aryl iodonium salts and the like. Specific examples include 1-hydroxy-cyclohexylphenylketone, benzophenone, 2-benzyl-2-(dimethylamino)-1-(4-(4-morphorlinyl)phenyl)-1-butanone, 2-methyl-1-(4-methylthio)phenyl-2-(4-morphorlinyl)-1-propanone, diphenyl-(2,4,6-trimethylbenzoyl)phosphine oxide, phenyl bis(2,4,6-trimethylbenzoyl)phosphine oxide, benzyl-dimethylketal, isopropylthioxanthone, 2,4,6-trimethylbenzoyldiphenylphosphine oxide (available as BASF LUCIRIN TPO), 2,4,6-trimethylbenzoylethoxyphenylphosphine oxide (available as BASF LUCIRIN TPO-L), bis(2,4,6-trimethylbenzoyl)-phenyl-phosphine oxide (available as BASF IRGACURE 819) and other acyl phosphines, 2-methyl-1-(4-methylthio)phenyl-2-(4-morphorlinyl)-1-propanone (available as BASF IRGACURE 907) and 1-(4-(2-hydroxyethoxyphenyl)-2-hydroxy-2-methylpropan-1-one (available as BASF IRGACURE 2959), 2-benzyl 2-dimethylamino 1-(4-morpholinophenyl)butanone-1 (available as BASF IRGACURE 369), 2-hydroxy-1-(4-(4-(2-hydroxy-2-methylpropionyl)-benzyl)-phenyl)-2-methylpropan-1-one (available as BASF IRGACURE 127), 2-dimethylamino-2-(4-methylbenzyl)-1-(4-morpholin-4-ylphenyl)-butanone (available as BASF IRGACURE 379), titanocenes, isopropylthioxanthone, 1-hydroxy-cyclohexylphenylketone, benzophenone, 2,4,6-trimethylbenzophenone, 4-methylbenzophenone, diphenyl-(2,4,6-trimethylbenzoyl) phosphine oxide, 2,4,6-trimethylbenzoylphenylphosphinic acid ethyl ester, oligo(2-hydroxy-2-methyl-1-(4-(1-methylvinyl)phenyl) propanone), 2-hydroxy-2-methyl-1-phenyl-1-propanone, benzyl-dimethylketal, CYRACURE UVI-6990 from Dow Chemical, R-GEN® BF-1172 from Chitec Chemical Co., 4-methylphenyl-(4-(2-methylpropyl)phenyl)iodonium hexafluorophosphate and the like, as well as mixtures thereof.

Optionally, the phase change inks can also contain an amine synergist, which are co-initiators that can donate a hydrogen atom to a photoinitiator and thereby form a radical species that initiates polymerization, and can also consume dissolved oxygen, which inhibits free-radical polymerization, thereby increasing the speed of polymerization. Examples of suitable amine synergists include, for example, ethyl-4-dimethylaminobenzoate, 2-ethylhexyl-4-dimethylaminobenzoate, and the like, as well as mixtures thereof.

Initiators that absorb radiation, for example UV light radiation, to initiate curing of the curable components of the ink may be used. Initiators for inks disclosed herein can absorb radiation at any desired or effective wavelength, for example in one embodiment from about 200 to 600 nanometers, and in one embodiment about 200 to 500 nanometers, and in another embodiment about 200-420 nanometers. Curing of the ink can be effected by exposure of the ink image to actinic radiation for any desired or effective period of time, in one embodiment from about 0.01 second to about 30 seconds, in another embodiment from about 0.01 second to about 15 seconds, and in yet another embodiment from about 0.01 second to about 5 seconds. By curing is meant that the curable compounds in the ink undergo an increase in molecular weight upon exposure to actinic radiation, such as crosslinking, chain lengthening, or the like.

The initiator can be present in the ink in any desired or effective amount, for example in one embodiment from about 0.5 percent by weight of the ink to about 20 percent by weight of the ink, and in another embodiment from about 1 percent by weight of the ink to about 20 percent by weight of the ink, and in yet another embodiment from about 1 percent by weight of the ink to about 15 percent by weight of the ink.

The radiation curable phase change inks can also optionally contain an antioxidant. The optional antioxidants can protect the images from oxidation and can also protect the ink components from oxidation during the heating portion of the ink preparation process. Specific examples of suitable antioxidant stabilizers include, for example, NAUGARD® 524, NAUGARD® 635, NAUGARD® A, NAUGARD® L-403, and NAUGARD® 959, commercially available from Crompton Corporation, Middlebury, Conn.; IRGANOX® 1010 and IRGASTAB® UV 10, commercially available from Ciba Specialty Chemicals; GENORAD 16 and GENORAD 40) commercially available from Rahn AG, Zurich, Switzerland, and the like, as well as mixtures thereof. When present, the optional antioxidant is present in the ink in any desired or effective amount, for example in one embodiment at least about 0.01 percent by weight of the ink carrier, in another embodiment at least about 0.1 percent by weight of the ink carrier, and in yet another embodiment at least about 1 percent by weight of the ink carrier, and in one embodiment no more than about 20 percent by weight of the ink carrier, in another embodiment no more than about 5 percent by weight of the ink carrier, and in yet another embodiment no more than about 3 percent by weight of the ink carrier.

Additional ingredients for these UV curable gel materials and methods of forming the same are described in U.S. Pat. No. 8,142,557, the disclosure of which is hereby incorporated by reference in its entirety.

The gellant compositions disclosed herein are present in the radiation curable phase change ink in any desired or effective amount, in one embodiment from about 1 to about 25 percent by weight of the ink vehicle, and in another amount from about 1 to about 10 percent by weight of the ink vehicle, and in one embodiment from about 7 to about 10 percent by weight of the ink vehicle.

Figure 3:
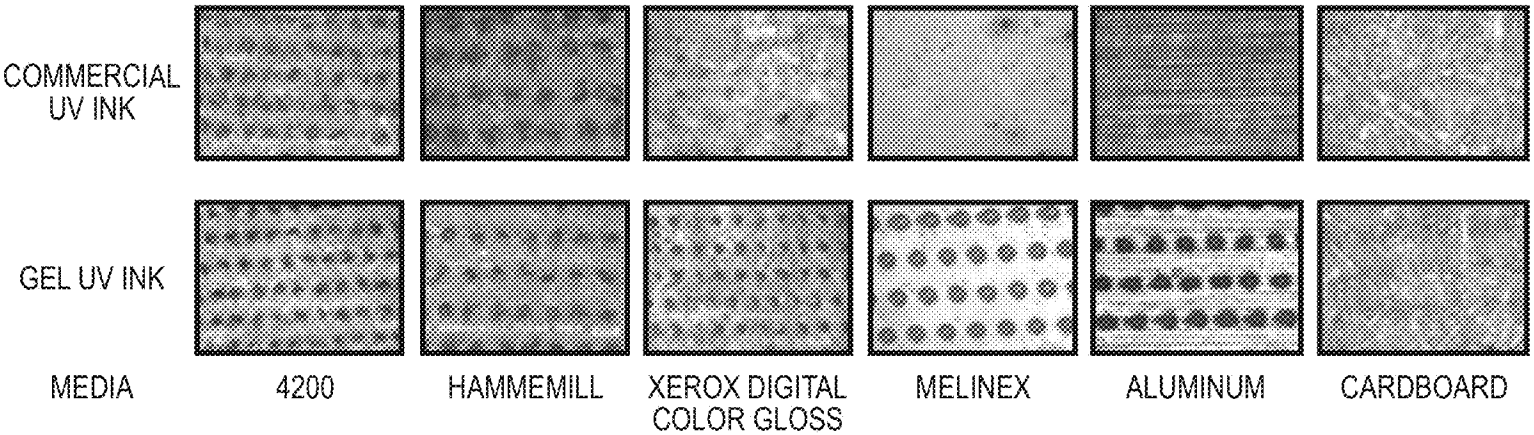
FIG. 3 illustrates results of a comparison of a commercial UV ink and a gel UV ink jetted onto a series of different substrates, as discussed in the examples of the present disclosure.

FIG. 3 illustrates a commercial UV ink and a gel UV ink jetted onto a series of different substrates. As is evident from the images in FIG. 3, the UV gel ink has an affinity for a number of different substrates which is unique to the formulation (contrast the images of the Commercial UV ink above). This can allow the gel ink to be transferred to non-typical media such as plastic films, metal surfaces, gloss paper, polyester packaging film, such as MELINEX, and cardboard.

Figure 4:
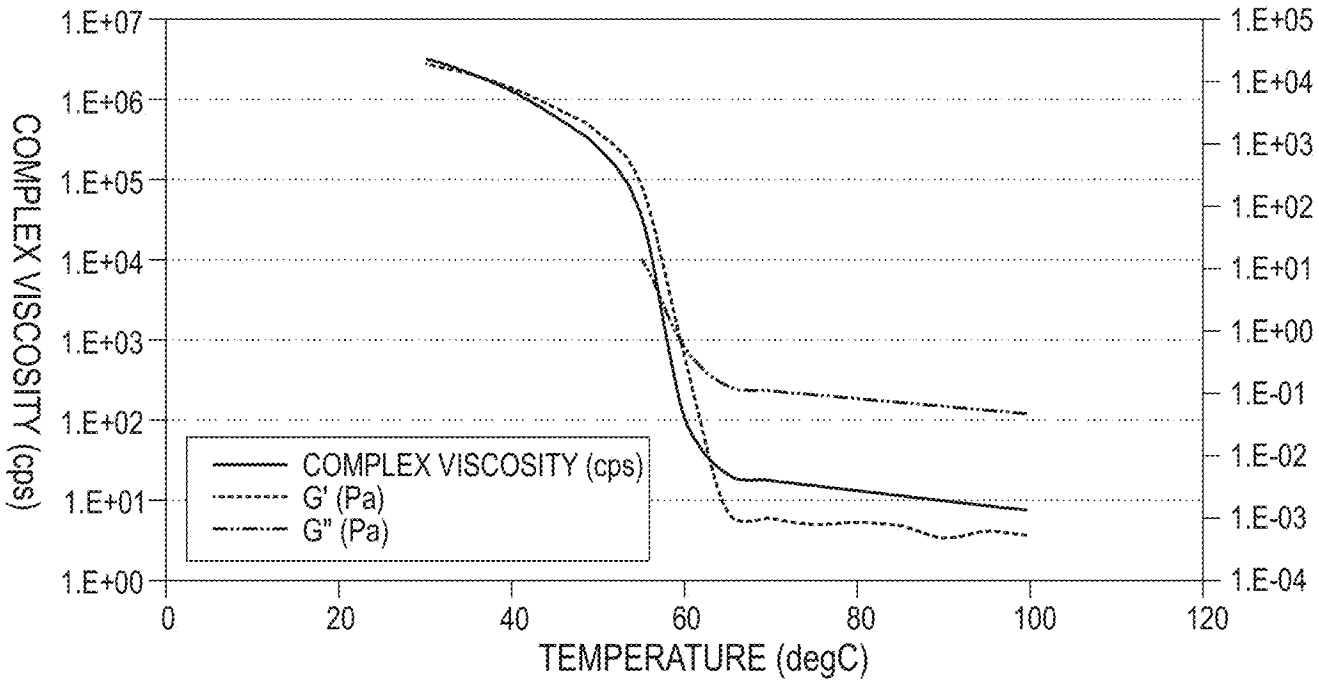
FIG. 4 shows a graph of viscosity data as a function of temperature as collected for a UV gel ink, as discussed in the examples of the present disclosure.

The inks are jetted as a liquid at an elevated temperature (typically 80-90° C.) from a piezoelectric printhead. As the ejected drops hit the substrate, they quickly gel as they cool to room temperature while maintaining a circular shape. The viscosity increases several orders of magnitude as the materials cool from the jetting temperature. This viscosity increase with cooling is illustrated in the graph of FIG. 4, which shows viscosity of a representative UV gel ink as a function of temperature (° C.). Thus, if further drop spread is required, heat can be applied to the intermediate transfer drum before transfer to the final substrate. In this manner, the dimensions of the transient ink pattern can be thermally tuned to improve image quality prior to transfer to the substrate. Adjusting the temperature can also be used to control release transfer of the ink and substrate fixing characteristics.

In an embodiment, the UV curable gel materials of the present disclosure are comprised of an amide gellant, as described above; a wax, such as UNILIN 350 acrylate wax (optionally prefiltered to 2 μm); SR833S monomer (Sartomer), and photoinitiators Irgacure 379, Irgacure 127, and Irgacure 819 (BASF). The stabilizer can be Irgastab UV10 (Ciba).

EXAMPLES

Examples 1-5 (Prophetic)

Formulation of Heterogeneous Gel Inks

A series of novel inks forming gels at high T containing different ratio and/or type of latex and Voranol 370 are prepared by mixing the components of Table 1, Example 1 to 5, with the Voranol 370 and adding the diethylenglycol last while stirring at RT with a magnetic stirrer.

TABLE 1

| Aqueous Gel Inks | | | | | |
|---|---|---|---|---|---|
| | Example 1 | Example 2 | Example 3 | Example 4 | Example 5 |
| | Gel at High T or upon Water Evaporation | | | | |
| Ink Components | wt % | wt % | wt % | wt % | wt % |
| Carbon Black (CAB-O-Jet 300, 14.9% solid) | 20 | 25 | 30 | 20 | 20 |
| Voranol 370 | 15 | 26 | 10 | 25 | 5 |
| Diethyleneglycol | 25 | | 30 | 20 | 20 |
| Sulfonated polyester (30% solid) | 18 | 18 | 13 | 15 | 18 |
| Amorphous Polyester Latex (36% solid) | | | | | 20 |
| Crystalline Polyester Latex (35.6% solid) | | | | | 2 |
| Phenyl Methacrylate Terpolymer Latex (36% solid) | 15 | 15 | 13 | | |
| Styrene-N-Butyl acrylate Latex (41.06% solid) | | | | 10 | |
| Kelcogel AFT (gelling agent) | | | | | |
| SFRP-PSS | | | | | |
| Trizma HCL | | | | | |
| Glycerol | | | | | |
| Butyl Carbitol | | | | | |
| Water | 7 | 16 | 4 | 10 | 15 |
| | 100 | 100 | 100 | 100 | 100 |
| Total Solid | 13.78 | 14.53 | 13.05 | 11.59 | 14.49 |

The ink compositions are formed by mixing carbon black (Cab-O-Jet 300 available from Cabot, dry), Voranol 370 available from Dow Chemicals, water, and sulfonated polyester (30% solution). After the components are homogeneously mixed together, the terpolymer latex (36% solution) (alternatively other types of latex can be used) are added while stirring with a magnetic stirrer. The specific compositions of the ink compositions, in weight percent, are shown in Table 1.

The ink compositions have a final solids content of greater than 10 weight %. The ink compositions are stable liquids at ambient temperature, but form high viscosity gels at high temperatures (>than about 35° C. and preferably greater than 50° C.).

The viscosities of the inks are expected to be about 4 cps to about 10 cps at 25° C.

Example 6 (Prophetic)

Heterogeneous Gel Inks Including Amorphous or Crystalline Polyester 190 grams of polyester resin are weighed out in a 1 L kettle. 100 g of methyl ethyl ketone (MEK) and 40 g of iso-propanol (IPA) are weighed out separately and mixed together in a beaker. The solvents are poured into the 1 L kettle containing the resin. The kettle, with its cover on, a gasket, a condenser and 2 rubber stoppers, are placed inside a water bath set at 48° C. (ensure Tr close to 45-46° C.) for 1 hour until the resins become "soft". The anchor blade impeller is set up in the kettle and switched on to rotate at approximately 150 RPM. After 3 hours, when all of the resins are dissolved, 8.69 g of 10% $NH_4OH$ are added to the mixture drop-wise with a disposable pipette through a rubber stopper. The mixture is left to stir for 10 minutes. Then 8.0 grams of Vazo 52 thermal initiator is added to the mixture and the mixture is stirred for an additional 10 minutes. 600 g of de-ionized water (DIW) is added into the kettle by a pump through a rubber stopper. The first 400 g are added in 90 minutes with the pump set to a rate of 4.44 g/min. The last 200 g are added in 30 minutes with the pump set to 6.7 g/min. The apparatus is dismantled, and the mixture is poured into a glass pan, which is kept in the fume hood overnight and stirred by a magnetic stir-bar so that the solvent can evaporate off. A particle size is taken at this stage. The particle size as measured by a Nicomp Particle Analyzer is 170 nm.

Example 7

Preparation of Styrene-n-Butyl Acrylate Latex

Latex A emulsion comprised of polymer particles generated from the emulsion polymerization of styrene, n-butyl acrylate and beta-CEA was prepared as follows. A surfactant solution consisting of 605 grams Dowfax 2A1 (anionic emulsifier) and 387 kg de-ionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80 degrees at a controlled rate, and held there. Separately 6.1 kg of ammonium persulfate initiator was dissolved in 30.2 kg of de-ionized water.

Separately the monomer emulsion was prepared in the following manner. 323 kg of styrene, 83 kg of butyl acrylate and 12.21 kg of β-CEA, 2.85 kg of 1-dodecanethiol, 1.42 kg of ADOD, 8.04 kg of Dowfax 2A1 (anionic surfactant), and 193 kg of deionized water were mixed to form an emulsion. 1% of the above emulsion was then slowly fed into the reactor containing the aqueous surfactant phase at 80° C. to form the "seeds" while being purged with nitrogen. The initiator solution was then slowly charged into the reactor and after 10 minutes the rest of the emulsion was continuously fed using a metering pump at a rate of 0.5%/min. After 100 minutes, half of the monomer emulsion had been added to the reactor. At this time, 3.42 kilograms of 1-dodecanethiol was stirred into the monomer emulsion, and the emulsion was continuously fed in at a rate of 0.5%/min. Also at this time the reactor stirrer was increased to 350 RPM. Once all the monomer emulsion was charged into the main reactor, the temperature was held at 80° C. for an additional 2 hours to complete the reaction. Full cooling was then applied and the reactor temperature was reduced to 35° C. The product was collected into a holding tank. The particle size was calculated to be 180 nanometers. After drying the latex the molecular properties were Mw=37,500 Mn=10,900 g/mol and the onset Tg was 55.0° C.

Examples 8-15 (Prophetic)

Low Temperature Gel Inks

A gel ink is made as follows using the proportions given in Table 1.

| | Example 8 | Example 9 | Example 10 | Example 11 | Example 12 | Example 13 | Example 14 | Example 15 |
|---|---|---|---|---|---|---|---|---|
| | Gel at BT | | | | | | | |
| Ink Components | wt % | wt % | wt % | wt % | wt % | wt % | wt % | wt % |
| Carbon Black (CAS-O-Jet 300, 14.9% solid) | 25 | 20 | 20 | 25 | 20 | 20 | 20 | 20 |
| Voranol 370 Diethyleneglycol Sulfonated polyester (30% solid) | 0 | 15 | 10 | 0 | 15 | 25 | 10 | 5 |
| Amorphous Polyester Latex (36% solid) | | | | | 10 | | | |
| Crystalline Polyester Latex (35.6% solid) | | | | | | | | |
| Phenyl Methacrylate Terpolymer Latex (36% solid) | | | | | | | 14 | |
| Styrene-N-Butyl acrylate Latex (41.06% solid) | 15 | 17 | 15 | 2 | 6 | 7 | 6 | 7 |
| Kelcogel AFT (gelling agent) | 0.5 | 0.5 | 0.5 | 1 | 0.5 | 0.5 | 0.25 | 1 |
| SFRP-PSS | 0.2 | 0.1 | | 2 | | 1 | 0.3 | 0.4 |
| Triama HCL | | | 0.2 | | 2 | | | |
| Glycerol | 25 | 15 | 15 | 30 | 10 | 5 | 15 | 20 |
| Butyl Carbitol | 5 | 5 | 5 | 5 | 5 | 5 | 5 | 5 |
| Water | 29.0 | 27.4 | 34.3 | 32 | 37.5 | 36.5 | 34.98 | 41.8 |
| | 100 | 100 | 100 | 100 | 100 | 100 | 100 | 100 |
| Total Solid | 10.58 | 10.58 | 9.84 | 7.65 | 7.08 | 7.85 | 9.07 | 7.25 |

Cold water (50% of the total amount) is mixed with an overhead mixer while the Kelcogel AFT® is added. Once addition is complete, the sample is heated to 60° C. until dissolved, approximately 30 minutes. Separately, the SFRP-PSS of Example 16 (see below) is pre-dissolved in the remaining amount of water at room temperature. The SFRP-PSS solution is then added to the water Kelcogel AFT® mixture, followed by the addition of the glycerol, butyl carbitol, carbon black and latex. The resulting ink sample is mixed while keeping the temperature at about 60° C. for another half an hour. The heat is turned off and the sample is mixed until cool.

Example 16

Synthesis of PSS by SFRP

Homopolymer Sodium styrenesulfonate (600 g), TEMPO (2,2,6,6,-tetramethyl-1-piperidinyloxy, free radical) (6.86 g, 0.44 mol), K2 S20 8 (6.59 g, 0.244 mol) and $Na_2CO_3$ (3.8 g) were added to a solution of ethylene glycol (1120 mL) and deionized water (480 mL) in a round bottomed flask (5 L) equipped with a gas inlet and condenser. The formed solution was deoxygenated by bubbling nitrogen through the solution while heating to reflux. The solution was heated for 8 hours and then cooled and precipitated into 10 L of an acetone/methanol (80:20) solution. The resulting precipitate was left standing over the weekend, decanted and the solid filtered. The solid was washed once with a IL solution of acetone/methanol (1:1) then filtered and air dried. This was then dried in vacuo at 60° C. to yield 202 grams.

Example 17

Synthesis of Amide Gellant Precursor for Making UV Curable Gel Ink

The synthesis of the amide gellant precursor (organoamide) is shown below in Scheme 1. It is during the preparation of the organoamide that the oligomers are created (end-capping to make the esters in the final gellant does not change the oligomer distribution).

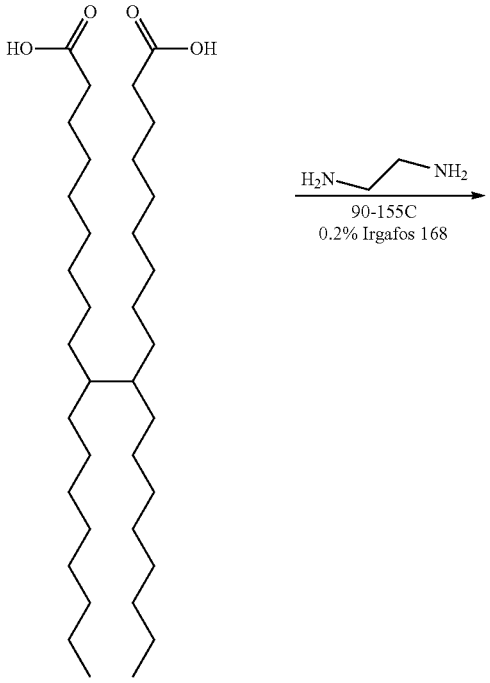

-continued

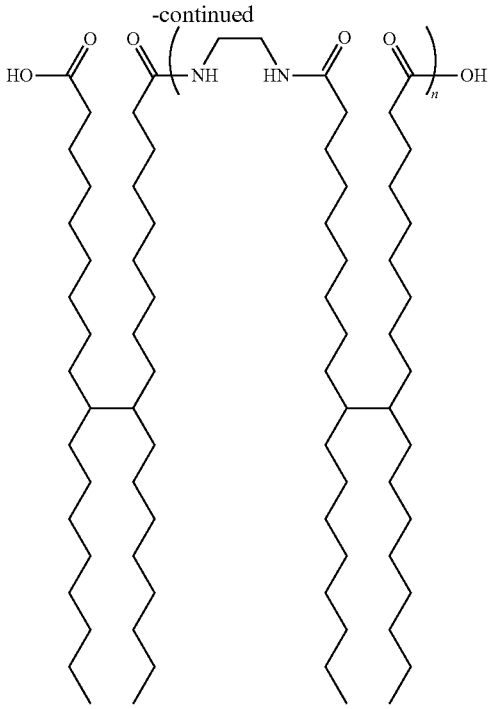

Scheme 1 Where n may be 0 to about 20, about 0 to about 15, or about 0 to about 10.

By controlling the amount of ethylenediamine (EDA), the distribution can be shifted to create larger proportions of the higher order oligomers. Generally, with higher EDA:Pripol ratios, the higher the gel point and room temperature viscosity of the gellant.

An amide gellant precursor using a EDA:Pripol ratio of 1.125:2 was prepared as follows. To a 2 L stainless steel reactor equipped with baffles and 4-blade impeller was added Pripol 1009 dimer diacid (Cognis Corporation) (703.1 g, acid number=194 mg/g, 1215 mmol). The reactor was purged with argon and heated to 90° C., and the impeller was turned on to 400 RPM. Next, ethylenediamine (Huntsman Chemical Corporation, 21.9 g, 364 mmol) was slowly added through a feed line directly into the reactor over 15 minutes. The reactor temperature was set 95° C. Next, the reactor temperature was ramped up to 165° Cover 280 minutes, and held at 165° C. for 1 hour. Finally, the molten organoamide product was discharged into a foil pan and allowed to cool to room temperature. The product was an amber-coloured solid resin. Acid#: 133.7.

Example 18

Preparation of the Amide Gellant

The synthesis of an amide gellant is shown below in Scheme 2. It involves an end-capping of the acid termini of the oligomers with phenyl glycol.

Scheme 2

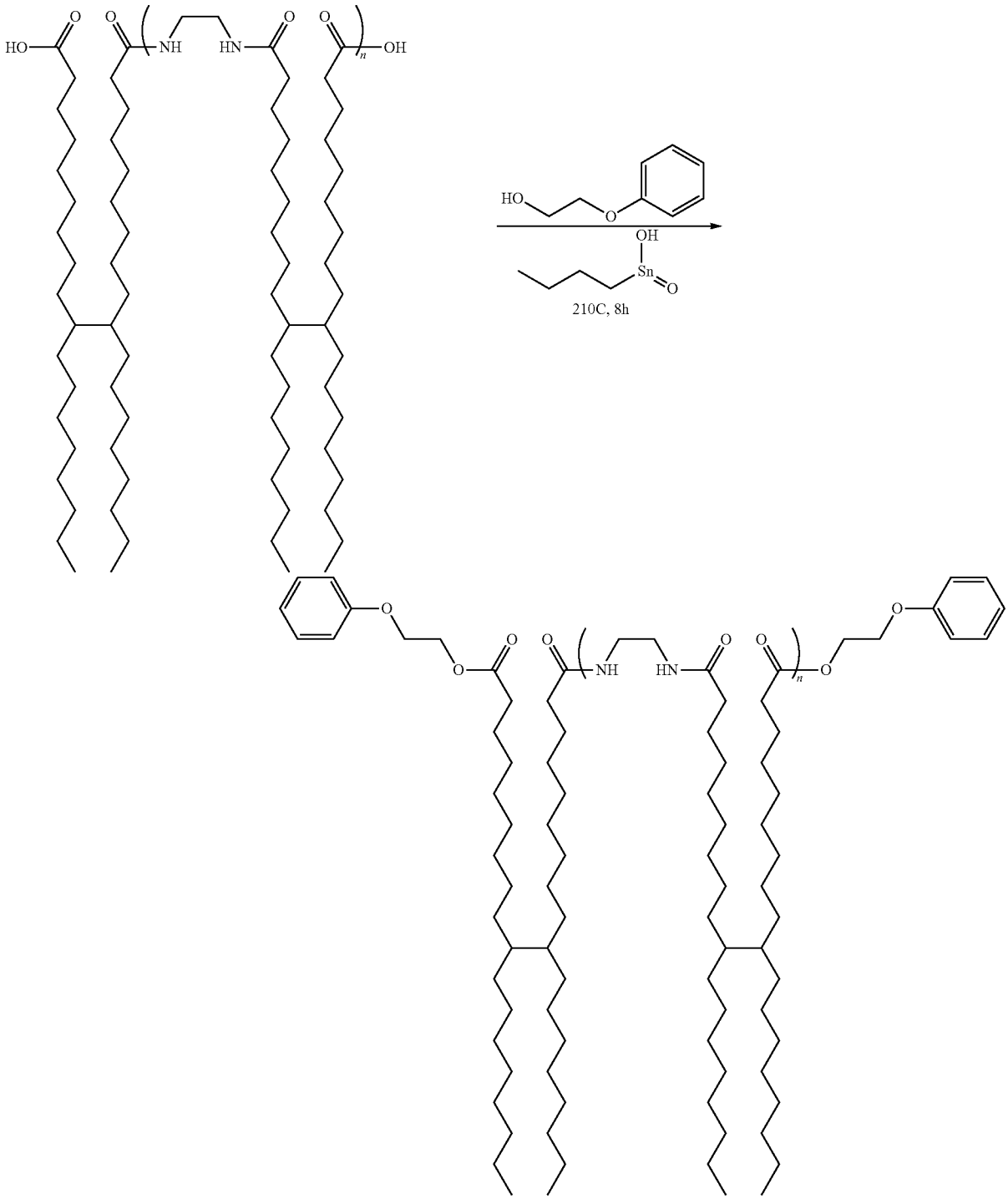

The oligomeric distributions for the amide gellant is summarized in Table 2.

A baseline amide gellant precursor using a EDA:Pripol ratio of 1.125:2 was prepared as follows. To a 2 L stainless steel Buchi reactor equipped with 4-blade steel impeller, baffle, and condenser was added organoamide (711.8 g, acid number=133.7, 614.65 mmol) via the addition port, using a heat gun to melt the materials. Next, the reactor was purged with $N_2$ gas at 3 SCFH (standard cubic feet per hour) flow rate, and heated to 210° C., and mixing at 450 RPM was started. Next, 2-phenoxyethanol (281.2 g, 2035.4 mmol, Aldrich Chemicals) and Fascat 4100 (0.70 g, 2.05 mmol, Arkema Inc.) were premixed in a beaker, and added to the reaction. The reaction port was closed, and the reaction was held at 210° C. for 2.5 hours. After 2.5 hours, the reactor port was opened, and 27.5 g more phenoxyethanol was added, and the reaction was allowed to run for 4 hours. After the reaction was completed, the molten gellant product was discharged into a foil pan and allowed to cool to room temperature. The produce was an amber-colored firm gel. Acid number=3.9.

TABLE 2

Mw Distributions by MALDI-TOF of Amide Gellant

| n | Name | Amide Gellant |
|---|---|---|
| 0 | Unimer | 26.7 |
| 1 | Dimer | 57.6 |
| 2 | Trimer | 14.7 |
| 3 | Tetramer | 0.9 |

Example 19

Synthesis of UNILIN® 350 Acrylate at 5 Gal Scale

About 5.4 kg of UNILIN® 350, 6.8 g of hydroquinone, 53.5 g of p-toluene sulfonic acid and 1.1 kg of toluene were charged through the charge port into a reactor. The charge port was closed and the reactor was heated to a jacket temperature of 120° C. Agitation was begun at minimum once the reactor contents reached a temperature of approximately 65° C. Once the internal reactor temperature reached 85° C., signaling that the solids have melted, agitation was increased to 150 rpm. The final two reagents were added via a Pope tank. First, 1.32 kg of acrylic acid were added and then the Pope tank and lines were rinsed through the reactor with 1.1 kg of toluene. The time of acrylic acid addition was marked as time zero. The jacket temperature was then ramped from 120° C. to 145° C. over 120 minutes. That was done manually with an increase of 2° C. every 10 minutes. During that time, reaction condensate (water) was cooled and collected by a condenser. Approximately 200 g of water were collected. Also, approximately 1.1 kg of toluene (50% of the charge) were removed by distillation along with the reaction condensate.

Once the reactor jacket reached the maximum temperature of 145° C., cooling was begun to bring the reactor to a batch temperature of 95° C. Agitation was reduced to 115 rpm. About 23 kg of deionized water ("DIW") were brought to boil and then charged to the reactor via the Pope tank (temperature of water by the time of transfer was greater than 90° C.). Mixing continued for 30 seconds and, after mixing was stopped, the water and waxy acrylate phases were allowed to separate. The bottom (water) phase was discharged to a steel pail from the bottom valve using the sight glass to monitor the interface. The extraction procedure was repeated with another 2.7 kg of hot DIW and the water discharged to a pail. A third and final extraction was conducted with 10 kg of hot DIW, separated but not discharged to a pail. Instead, the hot water layer was used to preheat the discharge line to a vacuum filter.

At the start of the experiment day, preparations were made to a vacuum filter for the discharge and precipitation steps. The filter was charged with 100 kg of DIW. Deionized cold water cooling and agitation at minimum were begun to the jacket of the filter to facilitate cooling the DIW to less than 10° C. for product solidification.

Following the third extraction, maximum agitation was begun to the filter. The reactor, the filter and the discharge lines were all checked for proper bonding and grounding, and both vessels were purged with nitrogen to ensure an inert atmosphere. The reactor was isolated and a moderate nitrogen blanket on the filter was begun, and was maintained throughout the discharge procedure.

After the final 10 minutes of separation time and once Tr=95° C., 5 kPa of nitrogen pressure were applied to the reactor. That ensured an inert atmosphere throughout the discharge procedure. The bottom valve was opened slightly and the hot reactor contents were slowly poured into the filter. The first layer was water and the next layer, the desired UNILIN 350 acrylate, which solidified into yellowish white particles. Once the discharge was complete, all nitrogen purges was stopped and both vessels vented to the atmosphere. Agitation continued on the filter for approximately 10 minutes. A flexible transfer line was connected from the central vacuum system to a waste receiver. Full vacuum was applied to the waste receiver, then the bottom valve of the filter was opened to vacuum transfer the water filtrate.

Once a dried sample of the material had an acid number of <1.5, the batch was discharged by hand into foil-lined trays, and dried in a vacuum oven at 55° C. with full vacuum overnight. The next day, the dry material was discharged and stored in 5 gallon pails. The yield from the batch was approximately 5.2 kg.

Inks were each prepared on a 20 gram scale by combining all components, except the pigment dispersion, and mixing the components at 90° C. and 200 rpm for approximately 1 hour. After 1 hour, the pigment dispersion was added to each ink and the combined ink composition was stirred at 90° C. for an additional hour. The inks were fully miscible, giving solutions with a pourable viscosity at elevated temperatures and forming stiff gels when cooled to room temperature.

Example 20

Cyan Pigment Dispersion Preparation

Into a 1 liter Attritor (Union Process) was added 1200 grams stainless steel shot (⅛ inch diameter), 30 grams B4G cyan pigment (Clariant), 18 grams EFKA 4340 dispersant, neat (BASF), and 152 grams SR9003 monomer (Sartomer). The mixture was stirred for 18 hours at 400 RPM, and then discharged into a 200 mL container. The resulting pigment dispersion has a pigment concentration of 15 weight percent.

Example 21

UV Curable Gel Material Preparation

About 7.5 g of amide gellant, 5 g of UNILIN 350 acrylate, 3 g of IRGACURE® 379 (BASF), 1 g of IRGACURE® 819, 3.5 g of IRGACURE® 127, 0.2 g of IRGASTAB® UV10, 5 g of SR399LV (Sartomer Company, Inc.), 54.8 g of SR833S (Sartomer Company, Inc.) were mixed at 90° C. for 1 h. This material was filtered through a 1 μm stacked filter. The filtered material was added to a colorant mixture as shown in Table 3 and additional SR833S as required to make-up the mass balance, while stirring at 90° C. The resulting pigmented material is stirred at 90° C. for 2 h, before filtration through a 1 μm filter.

TABLE 3

| Cyan UV Gel Material, 2 weight % | | |
|---|---|---|
| Component | wt % | Mass |
| Amide gellant | 7.5% | 7.50 |
| Unilin 350-acrylate | 5.0% | 5.00 |
| Low viscosity dipentaerythritol pentaacrylate | 5.0% | 5.00 |
| Tricyclodecane dimethanol diacrylate | 54.8% | 54.80 |
| Irgacure 379 | 3.0% | 3.00 |
| Irgacure 819 | 1.0% | 1.00 |
| Irgacure 127 | 3.5% | 3.50 |
| Irgastab UV10 | 0.2% | 0.20 |
| Cyan pigment dispersion 15 wt % pigment | 20.0% | 20.00 |
| TOTAL | 100.0% | 100.00 |

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. An indirect printing process for printing a gel ink, the process comprising:

providing a gel ink composition in an inkjet printing apparatus;

ejecting droplets of gel ink in an imagewise pattern onto an intermediate transfer member wherein each ink droplet forms a substantially circular image on the transfer member;

gelling the ink droplets and drying or solidifying the ink to form a substantially dry ink pattern on the intermediate transfer member, the substantially dry ink pattern comprising less than 5% by weight liquid vehicle, based on the weight of dried ink; and transferring the substantially dry ink pattern from the intermediate transfer member to a final substrate.

2. The process of claim 1, wherein each ink droplet surface has a circularity that deviates by less than 10% from each other.

3. The process of claim 1, wherein each ink droplet surface has a circularity that ranges from about 0.9 to about 1.2.

4. The process of claim 1, wherein each ink droplet surface has a circularity that ranges from about 0.9 to about 1.1.

5. The process of claim 1, wherein an average circularity of the ink droplets is substantially equal to 1.

6. The process of claim 1, wherein the substantially dry ink pattern comprises less than 2% by weight liquid vehicle, based on the weight of dried ink.

7. The process of claim 1, wherein the gel ink composition has a viscosity that is less than about 10 cps prior to ejecting; and a viscosity of greater than about $1\times10^6$ cps on the intermediate transfer member prior to transferring to the final substrate.

8. The process of claim 1, wherein the droplets of gel ink pin in place as they contact the intermediate substrate.

9. The process of claim 1, wherein the droplets of gel ink remain circular as they contact the intermediate substrate.

10. The process of claim 1, wherein the gel ink is an aqueous gel ink.

11. The process of claim 1, wherein the gel ink is a non-aqueous gel ink.

12. The process of claim 1, wherein the gel ink is a curable gel ink.

13. The process of claim 1, wherein the gel ink composition is a heterogeneous gel ink composition comprising:

a colorant;

a polymer latex selected from the group consisting of a terpolymer latex and a styrene-n-butyl acrylate latex;

an optional dissipatable polymer;

a dispersant; and a liquid vehicle.

14. The process of claim 13, wherein the heterogeneous gel ink composition comprises a solids content of at least 7% by weight based on the total gel ink composition.

15. The process of claim 13, wherein the liquid vehicle comprises water.

16. The process of claim 1, wherein the gel ink composition is a low temperature gel ink composition comprising:

a colorant;

a gelling agent;

an electrolyte;

a polymer latex selected from the group consisting of a an amorphous polyester latex, a crystalline polyester latex, a terpolymer latex and a styrene-n-butyl acrylate latex; and a liquid vehicle comprising water.

17. The process of claim 16, wherein the low temperature gel ink comprises a solids content of at least 10% by weight based on the total gel ink composition.

18. The process of claim 1, wherein the gel ink composition is a radiation curable phase change ink composition comprising:

a colorant;

a gelling agent;

a radiation curable carrier;

a wax; and a photoinitiator.

* * * * *